US006305776B1

(12) United States Patent
Ohshima et al.

(10) Patent No.: US 6,305,776 B1
(45) **Date of Patent: *Oct. 23, 2001**

(54) METHOD FOR JUDGING DISCHARGE STATE OF INK JET RECORDING HEAD, AND INK JET RECORDING APPARATUS UTILIZING THE SAME

(75) Inventors: Noriyoshi Ohshima, Tokyo; Yoshiyuki Shimamura; Seiji Takahashi, both of Yokohama, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/054,193

(22) Filed: Apr. 30, 1993

(30) Foreign Application Priority Data

May 8, 1992 (JP) ..... 4-116177

(51) Int. Cl.[7] ..... B41J 29/38
(52) U.S. Cl. ..... 347/17; 347/14; 347/23
(58) Field of Search ..... 346/104 R, 1.1; 347/14, 17, 23

(56) References Cited

U.S. PATENT DOCUMENTS

| | | | | |
|---|---|---|---|---|
| 4,313,124 | | 1/1982 | Hara | 346/140 R |
| 4,345,262 | | 8/1982 | Shirato et al. | 346/140 R |
| 4,459,600 | | 7/1984 | Sato et al. | 346/140 R |
| 4,463,359 | | 7/1984 | Ayata et al. | 346/1.1 |
| 4,558,333 | | 12/1985 | Sugitani et al. | 346/140 R |
| 4,608,577 | | 8/1986 | Hori | 346/140 R |
| 4,723,129 | | 2/1988 | Endo et al. | 346/1.1 |
| 4,740,796 | | 4/1988 | Endo et al. | 346/1.1 |
| 4,791,435 | * | 12/1988 | Smith et al. | 346/140 R |
| 4,926,196 | * | 5/1990 | Mizoguchi et al. | 346/140 R |
| 5,030,317 | | 7/1991 | Noguchi | 156/630 |
| 5,206,668 | * | 4/1993 | Lo et al. | 346/140 R |
| 5,485,179 | * | 1/1996 | Otsuka et al. | 347/14 |
| 5,485,182 | * | 1/1996 | Takayanagi et al. | 347/17 |

FOREIGN PATENT DOCUMENTS

| | | | | |
|---|---|---|---|---|
| 0443245 | | 8/1991 | (EP) . | |
| 0442705 A2 | * | 8/1991 | (EP) | B41J/2/05 |
| 0444861 A2 | * | 9/1991 | (EP) | B41J/2/175 |
| 54-056847 | | 5/1979 | (JP) . | |
| 59-123670 | | 7/1984 | (JP) . | |
| 59-138461 | | 8/1984 | (JP) . | |
| 60-071260 | | 4/1985 | (JP) . | |
| 62-253457 | | 11/1987 | (JP) . | |

* cited by examiner

*Primary Examiner*—John Barlow
*Assistant Examiner*—M Shah
(74) *Attorney, Agent, or Firm*—Fitzpatrick, Cella, Harper & Scinto

(57) ABSTRACT

The temperature characteristics of an ink jet recording head are detected, and the result of detection is utilized for detecting the ink discharge state. Also a statistical processing on the temperature characteristics detected on plural recording heads enables exact detection of the ink discharge state, not effected by the individual difference of the recording heads. Also there is detected the abnormality in ink discharge, that may occur prior to the exhaustion of ink in the ink tank.

26 Claims, 20 Drawing Sheets

METHOD FOR JUDGING DISCHARGE STATE OF INK JET RECORDING HEAD, AND INK JET RECORDING APPARATUS UTILIZING THE SAME

BACKGROUND OF THE INVENTION

1. Field of the Invention

The present invention relates to an ink jet recording apparatus adapted for use in a printer, a facsimile, a word processor, a copying machine or the like, and more particularly to a method for detecting the temperature characteristics of an ink jet recording head and judging the discharge state thereof.

2. Related Background Art

Recording apparatus for recording on a recording medium such as paper or a sheet for overhead projector have been commercialized in the form employing a recording head of various recording methods. Such recording head is known, for example, in the wire dot method, the thermal method, the thermal transfer method or the ink jet method. Particularly the ink jet method is attracting attention as a quiet recording method of a low running cost, since the ink is directly discharged onto the recording medium.

In such ink jet recording apparatus, an ink tank containing ink is connected to the recording head through an ink supply pipe, and the ink is supplied from such ink tank. Said ink tank may be formed as an ink cartridge which is separate from the recording head and is replaceably mounted in the recording apparatus, or as an integral unit with the recording head, which is integrally replaceably mounted in the recording apparatus.

In such ink jet recording apparatus, if the ink supply is interrupted because of the exhaustion of ink, the ink discharge becomes no longer possible so that the recording ability is lost. In order to avoid such situation, there has been commercialized the recording apparatus with a function of detecting the remaining ink amount, thus generating an alarm signal or requesting the replacement of the ink tank, according to the amount of consumption of ink.

For detecting the remaining ink amount, there has been proposed a method of counting the pulse signals supplied for ink discharge and thereby calculating the amount of ink consumption, a method of inspecting the change in the resistance of ink itself or of a member holding the ink, a method of detecting the weight change of the ink tank, or a method of forming a transparent area in an ink path in the ink tank or in the recording head and inspecting the presence or absence of ink in said ink path by the observation of the user or by a photosensor.

In the above-mentioned method utilizing the count of the ink discharge pulse signals, the remaining ink amount is detected by calculating the ink amount used in recording, from the product of the number of applied pulses and the amount of discharge per ink droplet discharged by a pulse.

Also the method of remaining amount detection by inspecting the resistance of ink etc. utilizes a fact that ordinary ink has a certain specific resistance due to the presence of water and other conductive substances therein, measures the resistance of the ink or the member holding the ink by means of a pair of electrodes provided for example in the ink tank, and detects the remaining ink amount based on a fact that the resistance between said electrodes is correlated with the remaining ink amount.

Also the method utilizing the weight change of the ink tank relies on the change of force applied to a spring provided in a member for mounting the ink tank, resulting from ink consumption, and detects the remaining ink amount by activating an electrical contact by the deformation of said spring.

However, such conventional methods as explained above have been associated with the following drawbacks.

The limit remaining amount, at which the recording operation becomes impossible, detected by the above-mentioned methods, is influenced for example by the unit-to-unit fluctuation of the recording head in manufacture, and is not highly reliable, so that the recording operation may be disabled immediately after the warning for such limit remaining amount or may still be properly conducted even after such warning. According to the experiments of the present inventors, such drawbacks is particularly conspicuous in case ink is held in the ink tank by means of an ink holding member such as sponge.

Besides the amount of ink droplet discharge per pulse is influenced not only by the unit-to-unit fluctuation of the recording head but also by the ambient temperature, so that the exact calculation of the amount of ink consumption is difficult. Furthermore, the detection by visual inspection or by photosensor has been unable to provide sufficient accuracy.

Furthermore, the configuration becomes complex by the presence of the detection members such as the spring or the photosensor, or the presence of the transparent area, for the detection of the remaining ink amount.

Furthermore, the above-mentioned conventional methods, though being capable of detecting the disabled recording state resulting from the interruption of ink supply caused by the ink exhaustion, are unable to detect the disabled recording state that may occur before the complete exhaustion of ink. Such disabled recording state before the ink exhaustion may be caused, for example, by bubble formation, by air intrusion, in the ink path between the ink tank and the recording head, or by interruption of ink supply due to generation or growth of a remaining bubble in a recording head designed to generate a bubble for ink discharge, or by destruction of meniscus at the ink discharge opening due to vibration applied to the recording apparatus or the recording head, thereby causing the liquid to flow into the nozzle of the recording head from said ink discharge opening.

SUMMARY OF THE INVENTION

In consideration of the foregoing, the principal object of the present invention is to provide an ink jet recording apparatus capable of detecting the temperature characteristics for each recording head and of effecting high precise detection of the ink discharge state based on thus detected temperature characteristics. Another object of the present invention is to provide a method for detecting the temperature characteristics of the ink jet recording head, and a method for judging the ink discharge state of the ink jet recording head.

The foregoing objects can be attained, according to the present invention, by an ink jet recording apparatus for effecting recording by discharging ink from a discharge opening onto a recording medium, comprising an electrothermal converter provided in said recording head; temperature detection means for detecting the temperature of said recording head; and temperature characteristic detection means for applying a predetermined energy to said electrothermal converter, detecting the temperature change of said recording head resulting from said energy application by means of said temperature detection means and detecting the temperature characteristics of said recording head based on the result of said detection.

Also according to the present invention, there is provided an ink jet recording apparatus for effecting recording by means of a recording head capable of discharging ink from a discharge opening onto a recording medium, comprising input means for enabling the operator to instruct the execution of detection of the ink discharge state of said recording head, and ink discharge state detection means for causing said recording head to discharge ink and detecting the state of ink discharge thereof, in response to the instruction of the operator through said input means.

Also according to the present invention, there is provided an ink jet recording apparatus for effecting recording by means of a recording head capable of discharging ink from a discharge opening onto a recording medium, comprising ink discharge state detection means for detecting the ink discharge state of said recording head, and control means for controlling said ink discharge state detection means, in case defective ink discharge from said recording head is detected by said means, thereby causing said means to again detect the ink discharge state.

Also according to the present invention, there is provided an ink jet recording apparatus for effecting recording by means of a recording head capable of discharging ink from a discharge opening onto a recording medium, comprising an electrothermal converter provided in said recording head; temperature detection means for detecting the temperature in the vicinity of said recording head; and judging means for judging the ink discharge state of said recording head, through comparison of the temperature characteristics of said recording head determined by the temperature change in the vicinity of said recording head in response to a predetermined energy applied to said electrothermal converter and the temperature detected by said temperature detection means.

Also according to the present invention, there is provided an ink jet recording apparatus for effecting recording by means of a recording head capable of discharging ink from a discharge opening onto a recording medium, comprising ink discharge state detection means for detecting the ink discharge state of said recording head, and memory means for storing, in case said ink discharge state detection means detects defective ink discharge from said recording head, the recording data at least since the latest detection of the satisfactory ink discharge state.

Also according to the present invention, there is provided a method for detecting the temperature characteristics of an ink jet recording head, comprising steps of applying a predetermined energy to an electrothermal converter provided in the recording head for effecting recording by discharging ink from a discharge opening onto a recording medium, detecting the temperature change in said recording head resulting from said energy application, and, based on said detection, detecting the temperature characteristics of said recording head.

Also according to the present invention, there is provided a method for judging the discharge state of an ink jet recording head, which comprises judging the ink discharge state of said recording head, based on the result of detection of the temperature characteristics according to the above-mentioned method.

According to the configuration of the present invention, in an ink jet recording apparatus for effecting recording by means of a recording head capable of discharging ink from a discharge opening onto a recording medium, a predetermined energy is applied to an electrothermal converter provided in said recording head, then the temperature change of said recording head resulting from said energy application is detected by said temperature detection means, and, based on the result of said detection, the temperature characteristic detection means detects the temperature characteristics of said recording head.

Also based on the result of detection of the temperature characteristics of the recording head obtained by said temperature characteristic detection means, the judging means judges the ink discharge state of said recording head.

DETAILED DESCRIPTION OF THE PREFERRED EMBODIMENTS

Now the present invention will be clarified in detail by preferred embodiments thereof shown in the attached drawings.

Figure 1:
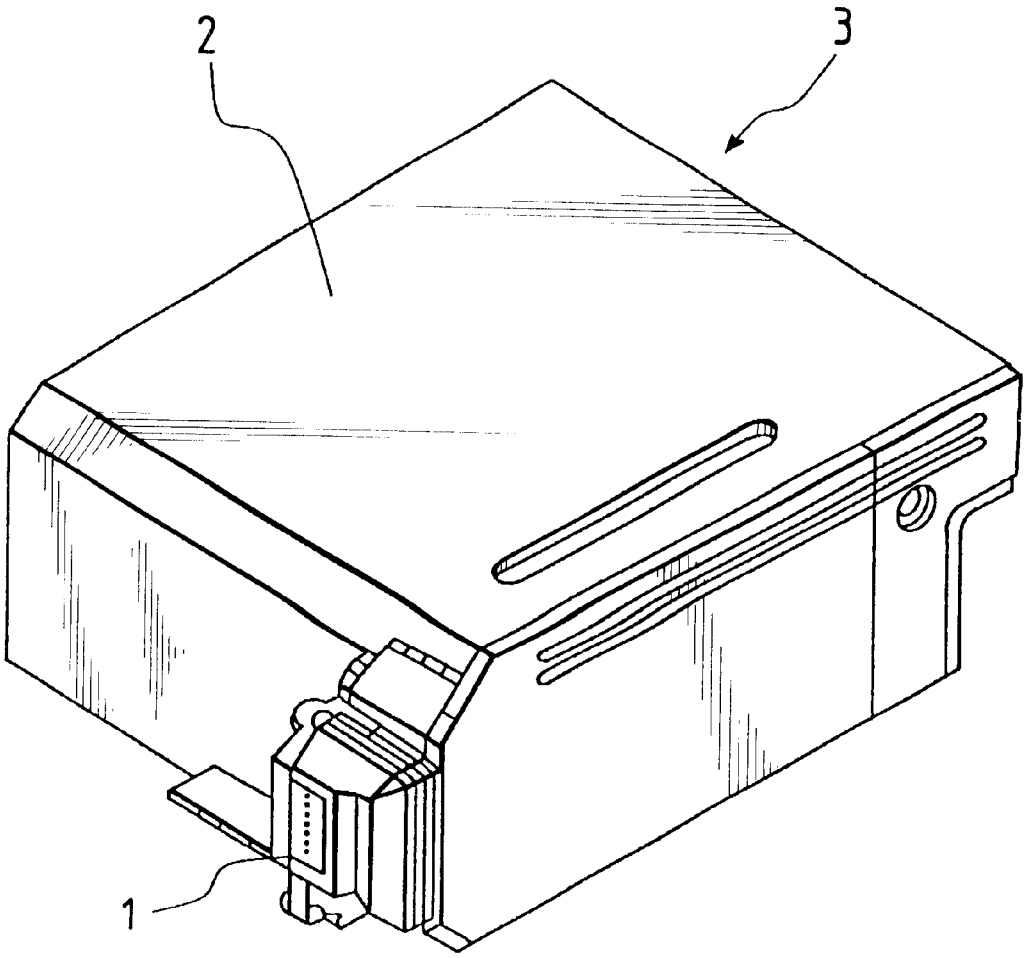
FIG. 1 is a schematic perspective view of an ink jet cartridge of the present invention.
Figure 2:
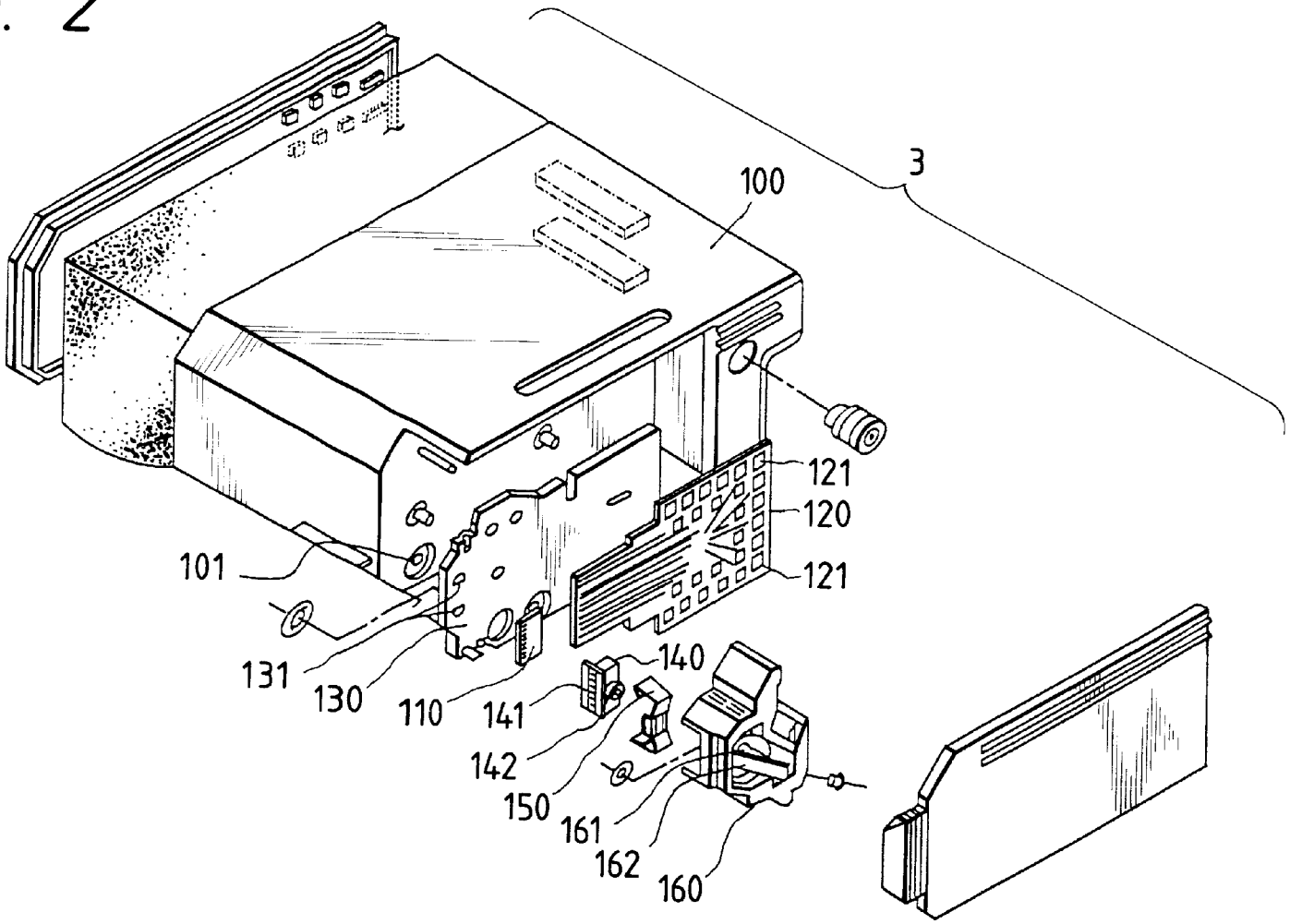
FIG. 2 is an exploded perspective view of an ink jet cartridge of the present invention.

FIG. 1 is a perspective view of a head cartridge 3 integrally composed of a recording head 1 and an ink tank 2, in which the present invention is applicable, and FIG. 2 is an exploded perspective view of the head cartridge 3, wherein shown are a heater board 110 provided with plural discharge heaters formed in an array on a Si substrate and electrical wirings for supplying electric power thereto; a grooved cover plate 140 integrally provided with plural nozzles, an orifice plate 141 having discharge openings corresponding thereto, and a common liquid chamber for containing ink for supply to said nozzles; a wiring board 120 which is connected at an end to the heater board 110 for example by wire bonding and is provided at the other end with pads 121 for receiving electrical signals from the main body of the recording apparatus; and a metal base plate 130 on which said wiring board 120 and said heater board 110 are adhered for example with an adhesive material.

The heater board 110 and the grooved cover plate 140 are fixed to the base plate 130, by pinching said heater board 110 and the grooved cover plate 140 with a press spring 150 and engaging the leg portion thereof with a hole 131 in the base plate 130. An ink supply member 160 is provided with an ink supply pipe 161 and an ink pipe 162 connected thereto. The ink supply pipe 161 is connected to an ink supply hole 101 of an ink tank 100, while the ink pipe 162 is connected to an ink receiving hole 142 of the grooved cover plate 140, whereby there is formed an ink path from the ink tank 100 to the discharge openings of the orifice plate 141.

Figure 3A:
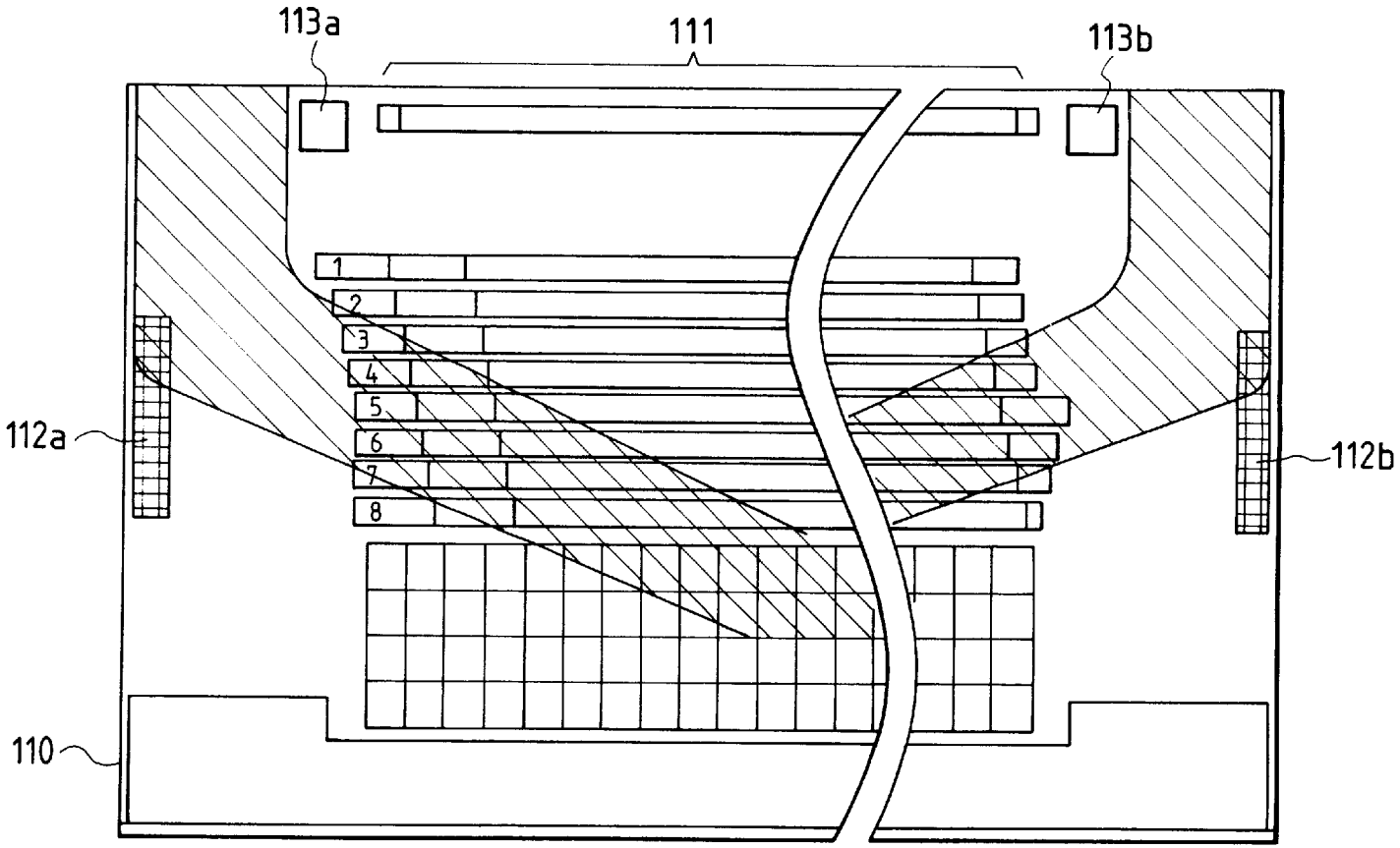
FIGS. 3A, 3B and 3C are schematic views of a recording part of the ink jet cartridge shown in FIG. 2.
Figure 3B:
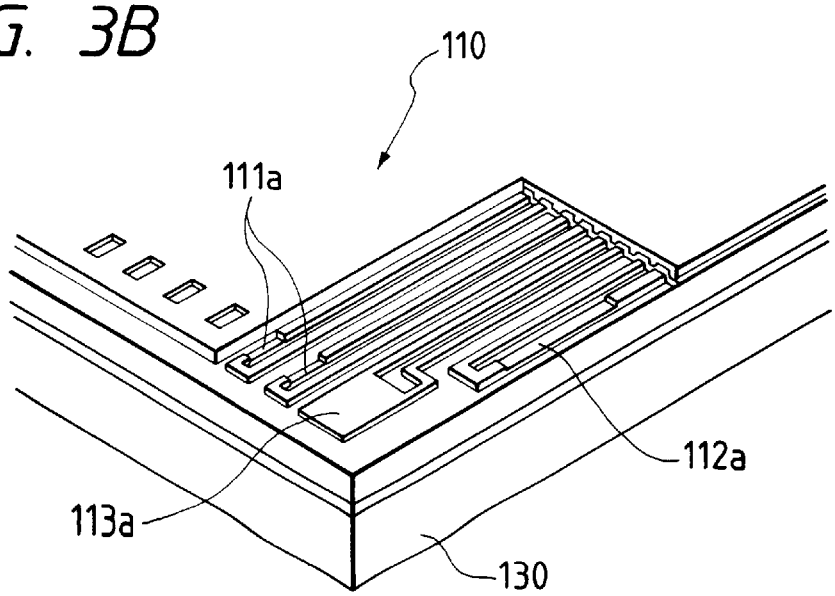

FIG. 3A shows the details of said heater board 110, and FIG. 3B is a partially cut off perspective view thereof. There is shown an array 111 of discharge heaters 111*a*, provided respectively corresponding to nozzles, communicating with the discharge openings of the orifice plate 141. By applying a voltage to said array 111 of the discharge heaters, the ink in the nozzles obtains thermal energy and is discharged as droplets from the discharge openings of the orifice plate 141, to effect the recording operation. Heaters 112*a*, 112*b* for temperature regulation can heat the vicinity of the heater board 110. Temperature sensors 113*a*, 113*b*, which can be formed by the semiconductor film forming technology in a similar manner as the heater array 111 and the heaters 112*a*, 112*b* and simultaneously therewith, can detect the temperature in the vicinity of the heater array 111.

Hatched areas indicate the connecting portions with the grooved cover plate 140. Each of the discharge heaters constituting the array 111 is an electrothermal converter of a resistance of 120Ω, capable of providing an energy of about 3 W with a driving voltage of 19 V. Also each of the heaters 112*a*, 112*b*, is composed of an electrothermal converter of a resistance of 144Ω, capable of providing an energy of 4 W with a driving voltage of 24 V. Each of the temperature sensors 113*a*, 113*b* is composed of a diode sensor, varying the output by about 2.5 mV per one degree of temperature.

In the following there will be given an explanation on the principle of ink discharge of the recording head, adapted for use in the ink jet recording apparatus of the present embodiment as the recording means of the present invention.

The recording head, adapted for use in the ink jet recording apparatus, is generally provided with a fine liquid discharging opening (orifice), a liquid path, an energy action part provided in a part of said liquid path, and energy generating means for generating a droplet forming energy to be applied to the liquid present in said energy action part, and is rendered replaceable. Such energy generating means can, for example, be a mechanism utilizing an electromechanical converter such as a piezoelectric element, a mechanism in which an irradiating electromagnetic wave such as a laser beam is absorbed in liquid to generate heat therein and a droplet is discharged and is caused to fly by the action of heat generation, or a mechanism in which liquid is heated by an electrothermal converter to cause a droplet to fly.

Among these mechanisms, the recording head of the ink jet recording utilizing the thermal energy for liquid discharge is capable of recording with a high resolving power, since the liquid discharging openings (orifices) for discharging recording liquid to form flying droplets can be arranged with a high density. Besides, the recording head utilizing the electrothermal converters as the energy generating means can be formed in a compact structure, and can also be easily formed as a long and flat or two-dimensional configuration, fully exploiting the advantages of the semiconductor technology and the microworking technology, showing remarkable progress and improvement in reliability in recent years. It has therefore been rendered possible to provide an ink jet recording head, which can be easily formed in a configuration with multiple nozzles and with a high density, and which has satisfactory mass producibility and a low manufacturing cost.

Such ink jet recording head employing an electrothermal converter for the energy generating means and produced with a semiconductor manufacturing process is generally provided with liquid paths respectively corresponding to ink discharge openings, in which an electrothermal converter is provided in each liquid path for applying thermal energy to the liquid present in each liquid path thereby discharging liquid from the corresponding ink discharge opening and forming a flying droplet, and in which the liquid is supplied to the liquid paths from a common liquid chamber. With regard to the method for forming the ink discharge part, the present applicant has proposed, in the Japanese Patent Laid-Open Application No. 62-253457, a method of laminating, on a first substrate, a solid layer for at least forming the liquid paths, a layer of a material curable with actinic energy at least utilized for forming the walls of the liquid paths, and a second substrate, then laminating a mask on said second substrate, effecting irradiation with actinic energy ray from above said mask thereby curing at least the walls of the liquid paths in said curable material layer, and eliminating said solid layer and the uncured portions of said curable material layer from the space between the two substrates, thereby forming at least the liquid paths.

Figure 3C:
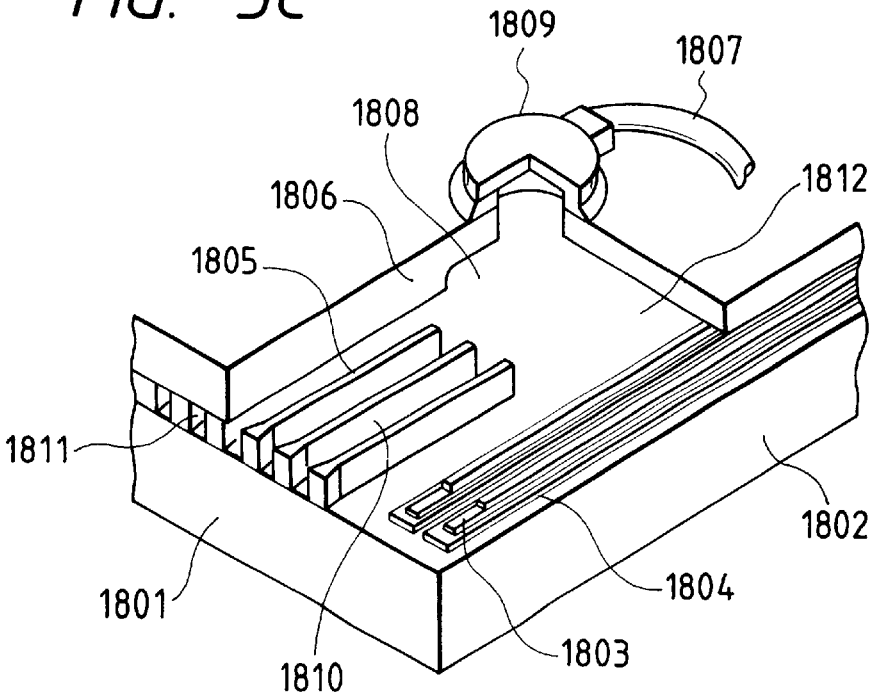

FIG. 3C is a schematic view of the ink jet recording head explained above. The recording head 1801 is composed of electrothermal converters 1803, electrodes 1804, liquid path walls 1805 and a cover plate 1806, formed through a semiconductor manufacturing process including the steps of etching, evaporation, sputtering etc.

In such recording head 1801, recording liquid 1812 is supplied from an unrepresented liquid reservoir to a common liquid chamber 1808 through a liquid supply pipe 1807.

There is also provided a liquid supply pipe connector 1809. The recording liquid 1812 supplied into the common liquid chamber 1808 is supplied into the liquid paths 1810 by the capillary action, and is stably maintained at the ink discharge openings 1811 at the ends of the liquid paths, by meniscus formation. A current supply to the electrothermal converter 1803 heats the liquid present thereon, thereby generating a bubble by film boiling phenomenon, and a liquid droplet is discharged from the ink discharge opening 1811 by the growth of said bubble. The above-explained configuration allows to obtain an ink jet recording head of multiple liquid paths, such as 128 or 250 liquid paths, with a high liquid path density such as 16 path/mm.

Figure 4:
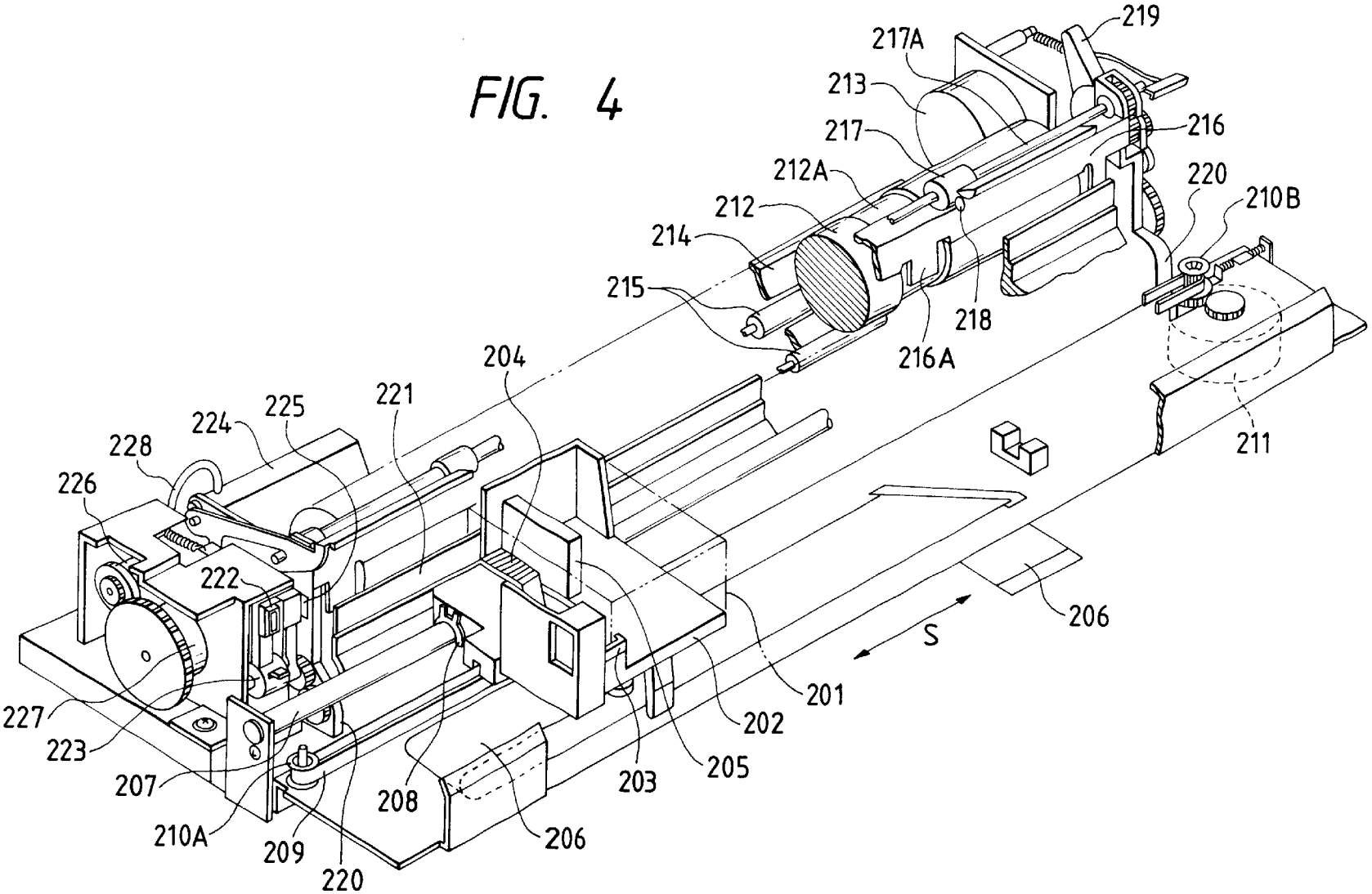
FIG. 4 is a schematic perspective view of an ink jet recording apparatus of the present invention.

FIG. 4 illustrates an example of the printer unit of the ink jet recording apparatus of the present embodiment. There are shown a head cartridge 201 including an ink jet recording head; a carriage 202 supporting the head cartridge 201 and effecting a scanning motion in a direction S; a hook 203 for mounting the head cartridge 201 onto the carriage 202; a lever 204 for operating the hook 203; a support plate 205 for supporting an electrical connecting part for the head cartridge; a flexible printed circuit (FPC) 206 for connecting said electrical connecting part and a control unit of the main body; and a guide shaft 207 inserted in a bearing 208 of the carriage 202, for guiding the same in a direction S.

A timing belt 209, connected to the carriage 202 for moving the same in the direction S, is supported by pulleys 210A, 210B positioned on both ends of the apparatus. A pulley 210B receives the driving force from a carriage motor 211, through a transmission mechanism such as gears. A transport roller 212 serves to define the recording face of the recording medium such as paper, and to transport said recording medium at the recording operation, and is driven by a transport motor 213. There are also provided a paper pan 214 for guiding the recording medium to the recording position, and pinch rollers 215 provided in the feeding path of the recording medium for pressing the same to the transport roller 212 and for transporting the same.

There are further provided a platen 216 opposed to the discharge openings of the head cartridge 201 and serving to define the recording face of the recording medium; discharge rollers 217 positioned at the downstream side of the recording position in the advancing direction of the recording medium and serving to discharge the recording medium toward an unrepresented discharge exit; spurs 218 positioned corresponding to the discharge rollers 217 and serving to press the discharge rollers 217 across the recording medium, thereby generating the transporting force of the discharge rollers 217 on the recording medium; and a releasing lever 219 for releasing the biasing action of the pinch roller 215 and the spurs 218 for example at the setting of the recording medium.

The platen 216 is supported at both ends, rotatably about the shaft of the discharge rollers 217, and is biased from the stop position of the lateral plates 220 toward a front portion 221 of the paper pan 214. The transport roller 212 is in contact, in plural portions 212A of a reduced diameter, with the inside of the front portion 221 of said paper pan.

A cap 222, composed of an elastic material such as rubber and so positioned as to oppose to the face containing the ink discharge openings of the recording head at the home position, is so supports as to be contacted to or separated from said recording head. Said cap 222 is used for protecting the recording head in the non-recording state, or for the discharge recovery operation for the recording head.

Such discharge recovery operation is conducted for example by positioning the cap 222 opposite to said face containing the ink discharge openings and activating the energy generating elements, provided in the nozzles of the recording head for ink discharge, thereby discharging ink from all the discharge openings and thus eliminating bubbles and dusts which are the cause of defective discharge or viscosified ink unsuitable for recording (operation called preliminary discharge), or by covering said face containing the discharge openings with the cap 222 and forcedly sucking the ink from all the discharge openings with a suction pump, thereby eliminating the cause of defective discharge.

A pump 223 provides the suction force for forced discharge of ink and is used for sucking the ink received by the cap 222, at the discharge recovery operation by such forced discharge or by the preliminary discharged. A used ink tank 224, for receiving the used ink sucked by the pump 223, is connected with said pump 223 through a tube 228.

A blade 225, for wiping the face containing the discharge openings of the recording head, is supported movably between a position protruding toward the recording head for effecting the wiping operation in the course of carriage movement and a retracted position not engaging with said face. There are further provided a motor 226, and a cam device 227 for driving the pump 223 and moving the cap 222 and the blade 225 by the driving force transmitted from said motor 226.

Figure 5:
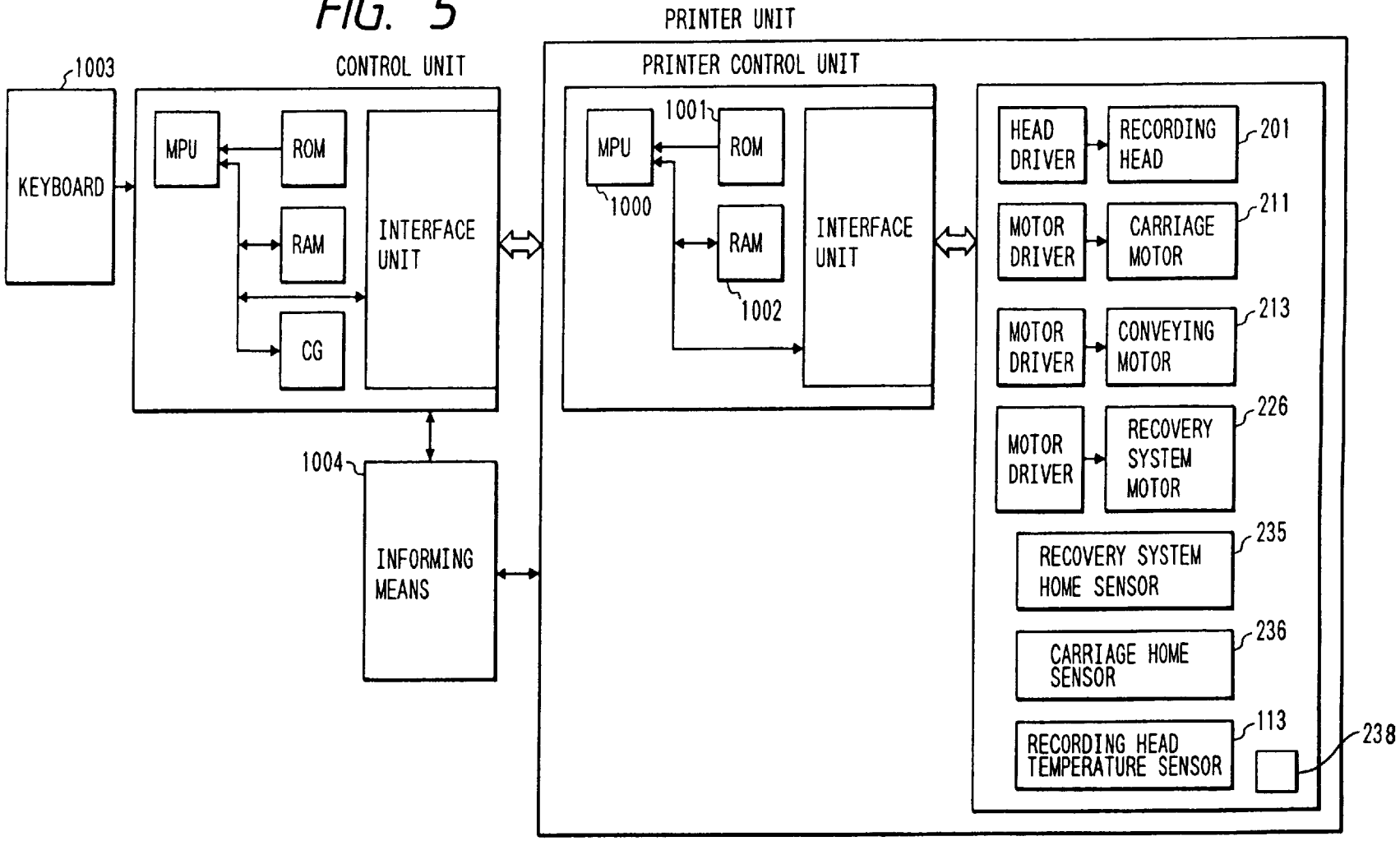
FIG. 5 is a block diagram of an ink jet recording apparatus constituting a 1st embodiment.

FIG. 5 is a block diagram showing an example of the control system of the recording apparatus explained above.

The capping position and the moved position of the carriage 202 shown in FIG. 4 can be known by a recovery system home position sensor 235 and a carriage home position sensor 236. In FIG. 5, there are shown an MPU 1000 for controlling various units by executing a control sequence according to a predetermined program; a ROM 1001 storing the program corresponding to said control sequence; and a RAM used as a work area in the execution of said control sequence.

In the following there will be given a detailed explanation on the measurement of the temperature characteristics of the above-explained recording head, and the method of detecting the discharge state of ink, utilizing said measurement.

[Embodiment 1]

At first there will be explained a first embodiment of the present invention.

Figure 6:
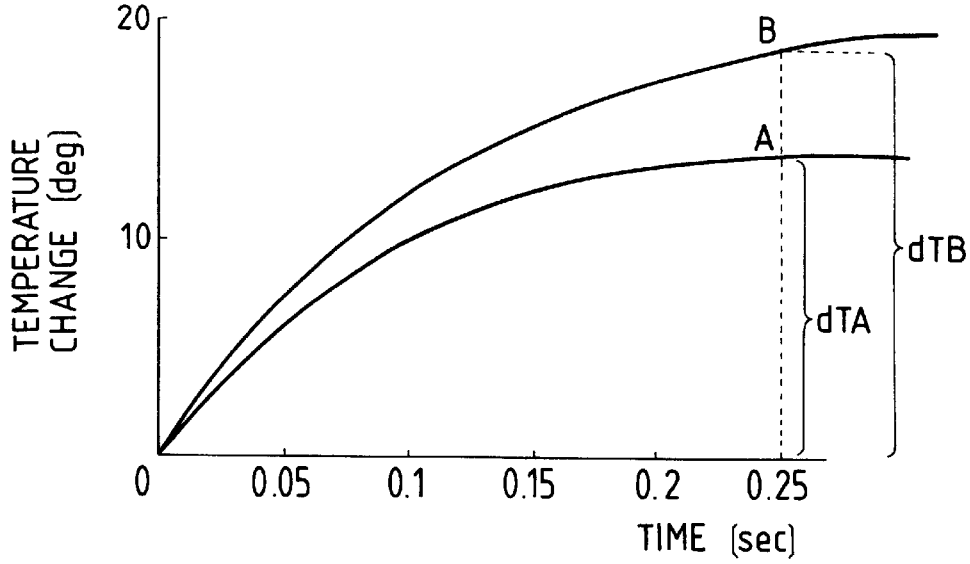
FIG. 6 is a chart showing the temperature change in the vicinity of a heater board in case an electrical energy is applied to a discharge heater.

FIG. 6 is a chart showing the temperature change in the vicinity of the heater board 110 when an electrical energy is given to the discharge heaters 111.

A curve A shows a state of normal ink discharge, while a curve B shows a state of absence of ink discharge due to insufficient ink filling in the liquid paths of nozzles in the recording head or in the common liquid chamber communicating thereto. It will be understood that the temperature change is larger in the absence of ink discharge (curve B) than in the presence of ink discharge (curve A). In general, the temperature of the heater board 110 is determined by the heat supply from the discharge heaters 111 constituting the heat source, and by the heat dissipation to the base plate 130 and the grooved cover plate 140. In the presence of ink discharge, the heat dissipation becomes larger because the ink is discharged to the outside with heat, and the difference in temperature characteristics results for this reason.

It is consequently possible to detect whether the ink discharge is possible, by detecting the temperature characteristics in the vicinity of the heater board 110 when a predetermined electrical energy inducing the ink discharge is applied to the discharge heaters 111.

Figure 7A:
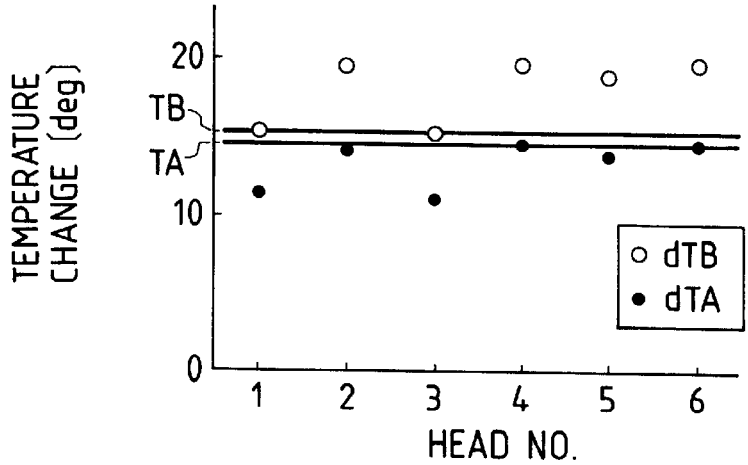
FIGS. 7A and 7B are charts showing the amount of temperature change in the vicinity of the heater board in the course of application of a predetermined energy to the discharge heater.

More specifically, at first the temperature change dTA is measured in the vicinity of the heater board 110 when the predetermined electrical energy inducing the ink discharge is applied to the discharge heaters 111 in a normal state in which the nozzles and the common liquid chamber communicating thereto are sufficiently filled with ink. Then the temperature change dTB after a predetermined time is measured in a state in which ink is absent in the nozzles and in the common liquid chamber. When these measurements are conducted on a plurality of heat cartridges and are statistically processed, there are obtained plottings as shown in FIG. 7A. In this manner there are determined, in advance, the maximum value TA of dTA and the minimum value TB of dTB.

Figure 11:
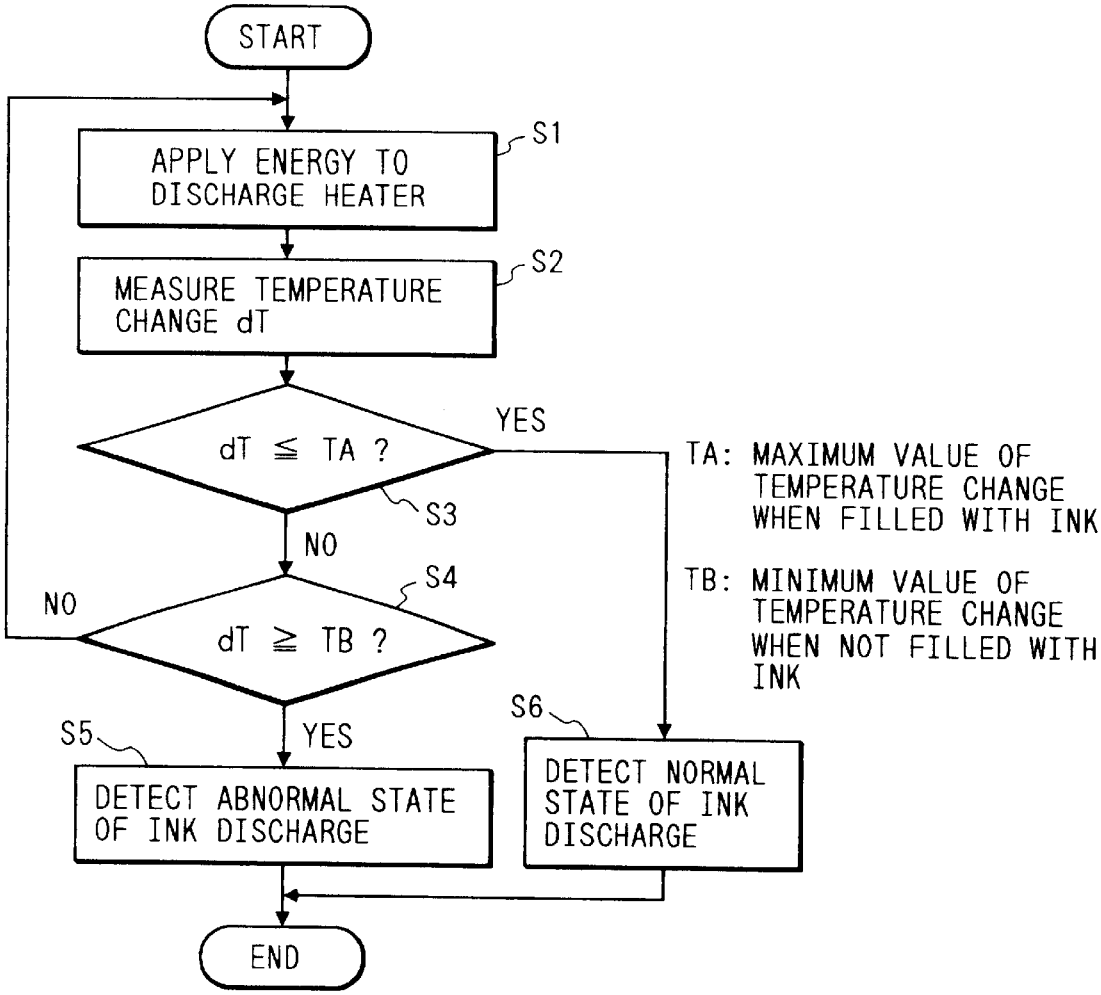
FIG. 11 is a flow chart showing a first method of detecting the ink discharge state described in the first embodiment.

FIG. 11 is a flow chart showing the sequence of detecting the ink discharge state, to be executed by the MPU 1000, and a corresponding program is stored in the ROM 1001. In the following there will be explained a first method for detecting whether the ink discharge is possible. At first the above-mentioned predetermined electrical energy is applied to the discharge heaters 111 (step S1). Then the temperature change dT in the vicinity of the heater board 110 is measured by the recording head temperature sensor 113 (step S2), and is compared with the values TA, TB (steps S3, S4). Based on said comparison, the ink discharge state is identified as normal if $dT \leqq TB$ (step S6), or as abnormal if $dT \geqq TB$ (step S5). Since TA and TB are determined from the measurements of a plurality of recording heads, there is not encountered a situation $TA<dT<TB$.

Figure 8A:
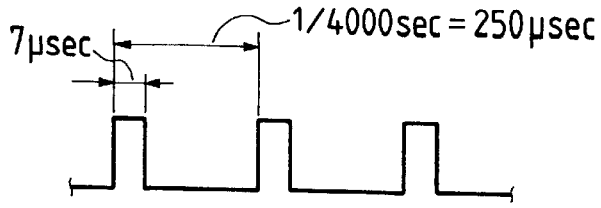
FIGS. 8A and 8B are charts showing an example of ink discharge and non-discharge conditions for the electrical energy in the present invention.

The above-mentioned predetermined electrical energy including ink discharge is, for example as shown in FIG. 8A, composed of 1000 pulses of a pulse duration of 7 $\mu$sec and a frequency of 4 kHz, applied to all of 64 nozzles, and said energy is defined as E1. In this case TA, TB are respectively about 14.5° and 15.5°.

In the following there will be explained a second method which is applicable even in case the temperature characteristics show a large fluctuation among different head cartridges.

Figure 7B:
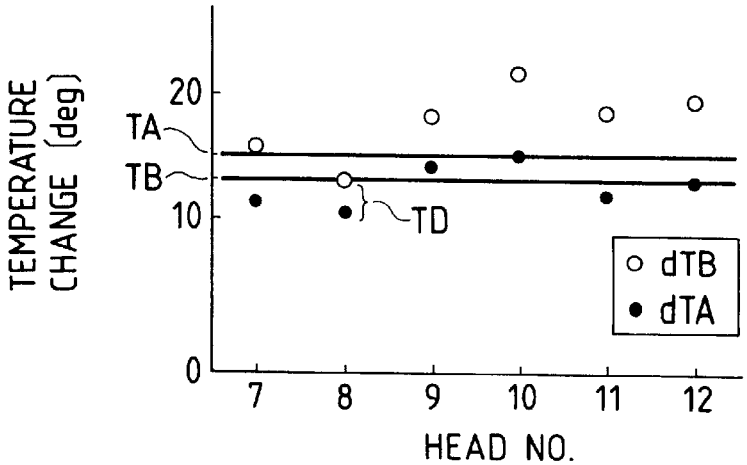

The above-explained method is not usable in case the fluctuation among different head cartridges is large so that the maximum value of dTA is larger than the minimum value of dTB, namely in case of $TA>TB$ as shown in FIG. 7B. Such fluctuation in the temperature characteristics may result from the fluctuation in the thickness of the adhesive material between the heater board 110 and the base plate 130, or in the resistance of the discharge heaters 111, or in the dimension or the physical properties of the heater board and the base plate. Also in case the ink discharge is conducted, such fluctuation may also arise from the change in the amount of heat dissipation by the in, due to variations in the size of ink droplets and in the physical properties of ink.

As the relationship $dTB>dTA$ stands for all the head cartridges as explained in relation to FIG. 6, a value ($dTB-dTA$) is calculated for each head cartridge and the minimum TD of said values is statistically determined, based on the data partially shown in FIG. 7B. Thus, a relationship $dTB-dTA \geqq TD$ stands for any head cartridge. Also it is assumed in general that the nozzles are in the normal ink filling state at the start of the recording operation, because of the automatic discharge recovery process.

Figure 12:
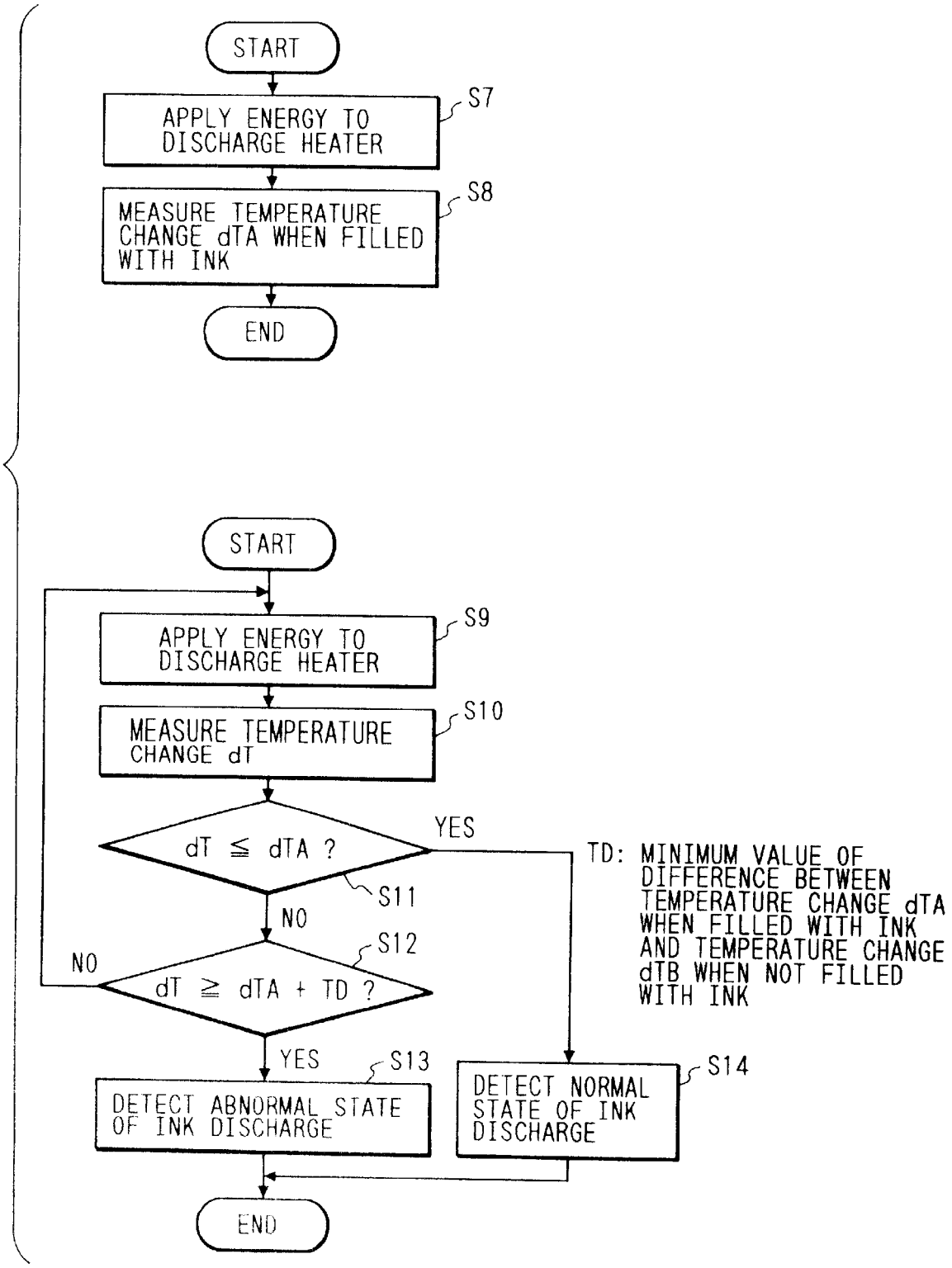
FIG. 12 is a flow chart showing a second method of detecting the ink discharge state described in the first embodiment.

FIG. 12 is a flow chart showing said second method. At first, at the start of the recording operation, at which the nozzles are in the normal ink filling state, the above-mentioned predetermined electrical energy is applied to the discharge heaters 111 (step S7), and the temperature change in the vicinity of the heater board 110 is measured in order to determined dTA (step S8). For detecting whether the ink discharge is possible, the above-mentioned predetermined electrical energy is applied to the discharge heaters 111 (step S9), then the temperature change dT in the vicinity of the heater board is measured (step S10), and the ink discharge state is identified as normal if $dT \leqq dTA$ (step S14), or as abnormal if $dT \geqq dTA+TD$ (step S13).

When said predetermined electrical energy is selected as E1 mentioned before, the TD becomes about 2°.

However, since this method unconditionally assumes that the temperature change in the vicinity of the heater board 110 is equal to dTA when said predetermined electrical energy is applied to the discharge heaters 111 at the start of the recording operation, there will be encountered an erroneous detection if the ink filling state of the nozzles becomes abnormal for some reason at the start of the recording operation.

In the following there will be explained a third method for avoiding this drawback, by utilizing reference temperature characteristics not related to the ink filling state of the nozzles, measured for each head cartridge.

As already explained in relation to FIG. 6, the difference in the temperature characteristics resulting from the ink filling state of the nozzles is caused by the heat dissipation at the ink discharge. Therefore, for obtaining the reference temperature characteristics mentioned above, there can be conceived to provide the discharge heaters with a low electrical energy that will not induce ink discharge even at the normal ink filling state of the nozzles.

Figure 8B:
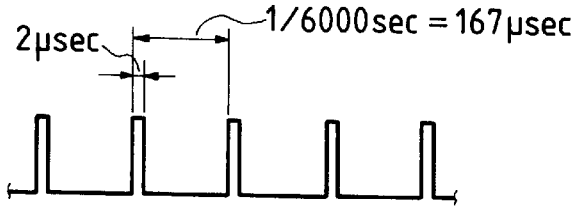

Said predetermined electrical energy not inducing the ink discharge even in the normal ink filling state of the nozzles can be, for example as shown in FIG. 8B, 3000 pulses of a pulse duration of 2 $\mu$sec and a frequency of 6 kHz applied to all of 64 nozzles, and said electrical energy is defined as E2. When said electrical energy E2 is applied to the discharge heaters 111, the temperature change in the vicinity of the heater board 110 remains substantially same regardless of the ink filling state of the nozzles, because the heat is not dissipated by the ink discharge.

Now, let us consider the relationship between the reference temperature characteristics, obtained by the application of the electrical energy E2 which does not induce the ink discharge even in the normal ink filling state of the nozzles and is exemplified in FIG. 8B, and the temperature characteristics, obtained by the application of the electrical energy E1 as shown in FIG. 8A and inducing the ink discharge.

Figure 9:
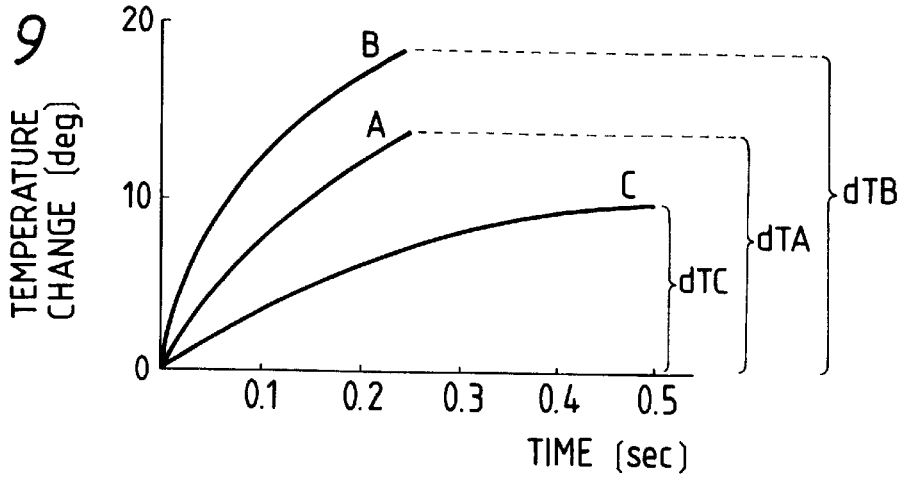
FIG. 9 is a chart showing temperature changes in the vicinity of the heater board in case two electrical energies of ink discharge condition and ink non-discharge condition are applied to the discharge heater.

FIG. 9 is a chart showing the temperature changes in the vicinity of the heater board 110, when the above-mentioned two electrical energies are applied to the discharge heaters 111.

A curve A shows a case with appropriate ink filling in the nozzles and in the common liquid chamber communicating therewith and with normal ink discharge under the application of the electrical energy E1, while a curve B indicates a case of absence of ink in the nozzles and in said common liquid chamber under the application of said electrical energy E1. A curve C indicates the case of application of the electrical energy E2, and the curve remains substantially same regardless of the ink filling state, as explained before. The respective temperature changes are represented by dTA, dTB and dTC.

When these measurements are conducted on plural head cartridges, the values of dTA, dTB, dTC are different among different head cartridges, but following relations stand for each head cartridge:

$$dTA=K1\times dTC$$

(K1 being constant for each cartridge)

$$dTB=K2\times dTC$$

(K2 being constant for each cartridge)

$$K1<K2$$

Thus, if the constants K1, K2 are known, the temperature changes dTA, dTB relating to the presence or absence of ink can be calculated from the temperature change dTC based on the reference temperature characteristics.

Then, let us give further consideration on the constants K1, K2.

Figure 10:
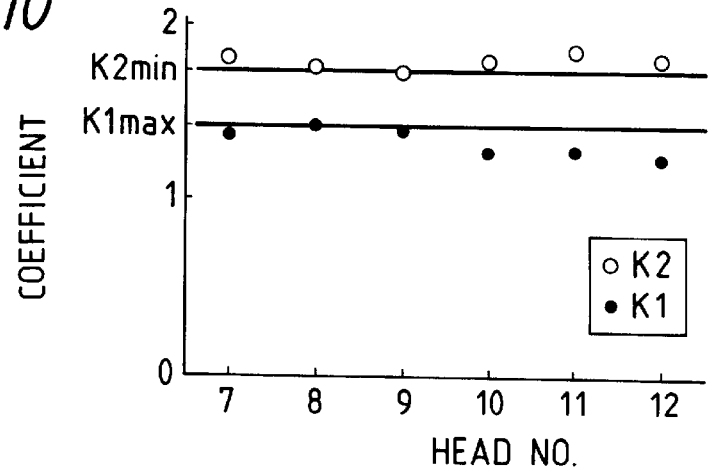
FIG. 10 is a chart showing constants obtained in case two electrical energies of ink discharge condition and ink non-discharge condition are applied to the discharge heater.

FIG. 10 shows the constants K1, K2 in the plural head cartridges Nos. 7 to 12, showing large fluctuations in the temperature characteristics, in the measurement shown in FIG. 7B. As will be seen from FIG. 10, there stands a relationship:

$$K1\max<K2\min$$

between the maximum value K1max of K1 and the minimum value K2min of K2. Said relationship stands even in the head cartridges with significant fluctuation in the temperature characteristics, because the ratios of the temperature changes dTA, dTB, dTC, based on the temperature characteristics of each cartridge, are considered instead of said temperature changes themselves.

Therefore, there are obtained relationship:

$$dTA\leqq K\times dTC$$

$$dTB\geqq K\times dTC$$

for all the head cartridges by selecting a new constant K so as to satisfy a relation:

$$K1\max<K<K2\min \quad (1).$$

Figure 13:
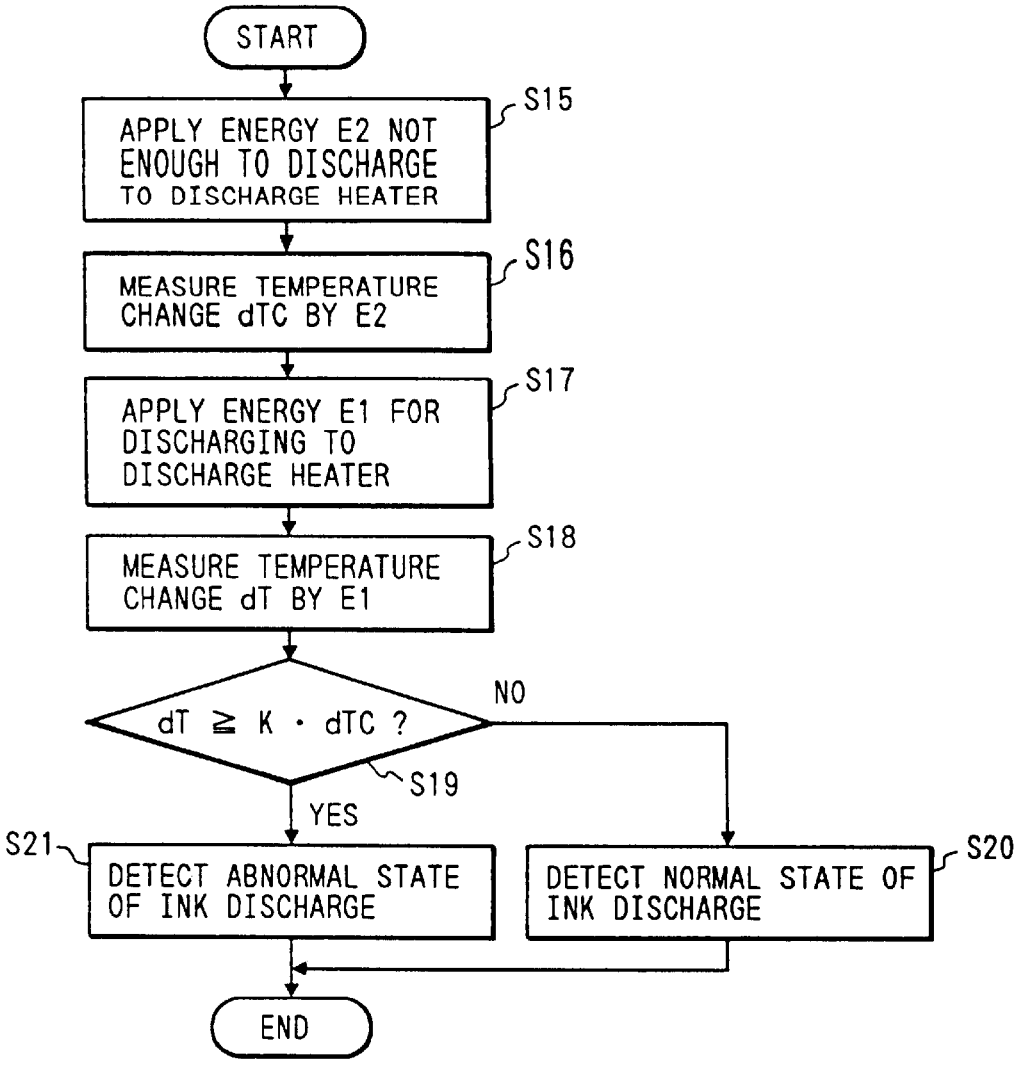
FIG. 13 is a flow chart showing a third method of detecting the ink discharge state described in the first embodiment.

FIG. 13 is a flow chart showing a detecting sequence for the ink discharge state, based on the above-mentioned relations. At first a predetermined electrical energy E2 not inducing the ink discharge is applied to the discharge heaters (step S15), and then the temperature change dTC of the recording head is measured (step S16). Subsequently a predetermined energy E1 inducing the ink discharge is applied to the discharge heaters (step S17), then the temperature change dT of the recording head is measured (step S18) and is compared with K×dTC (step S19), whereupon the ink discharge state is identified as normal if dT≦K×dTC (step S20) or as abnormal if dT≧K×dTC (step S21).

When the aforementioned electrical energies E1, E2 are adopted, the values of K1max, K2min were experimentally determined as about 1.45 and 1.75. Consequently, in this case, the value K can be selected for example as 1.6, in order to satisfy the aforementioned relation (1).

In the ink discharge state detecting methods explained above, the temperature detection by the temperature sensor is conducted during the application of the electrical energy to the discharge heaters. Since the temperature drops rapidly after the application of the predetermined energy, there may result an error in the detection if the detection is repeated plural times after said energy application. For this reason, the temperature detection is preferably conducted during the energy application.

However, if the energy application is executed in the pulse form as shown in FIGS. 8A and 8B, stable detection is difficult because of an abrupt temperature change or a noise generation when the pulse signal is turned on. In the present embodiment, therefore, the temperature detection in the course of energy application is conducted in synchronization with said pulses, when the pulse is turned off. Also if the temperature detection has to be conducted after the energy application, it is executed within a limited or short time after the energy application.

In the following there will be explained the recording process, with reference to FIG. 4, in a recording apparatus capable of detection of the temperature characteristics of the recording head and detection of the ink discharge state utilizing said temperature characteristics.

At first, when the power supply to the recording apparatus is turned on, the recovery motor 226 is activated to set the recovery unit at the home position of the recovery system and to retract the cap 222. Then the carriage 202 is set at the home position opposed to the cap 222. Then the cap 222 is again contacted with the nozzles of the recording head, and the entry of the recording data signal is awaited. In response to said entry, the transport motor 213 is activated to initiate the feeding of the recording medium, such as paper, up to a front end position of the desired recording. Then the cap 222 is retracted and separated from the nozzles of the recording head, and the carriage 202 is set at the home position opposed to the cap 222. Subsequently the predetermined preliminary discharge is executed, and the carriage 202 is moved to a desired recording start position. Said preliminary discharge in this embodiment is executed prior to the recording operation, and also in the course of the recording operation, by the movement of the carriage 202 to said home position again, after the lapse of a predetermined period of T seconds from the preceding preliminary discharge.

Thereafter desired recording operation is executed by the discharge of ink droplets according to ink discharge signals corresponding to the recording data. After the recording of a page of the recording medium, the recording medium is discharged, and there are conducted the detection of the temperature characteristics of the recording head and of the ink discharge state. In the present embodiment, the detection of the ink discharge state is conducted after the recording of a page. Thus said detection is executed after the recording of a page if the recording data are less than a page, or after the recording of each page if the recording data cover plural pages.

Figure 14:
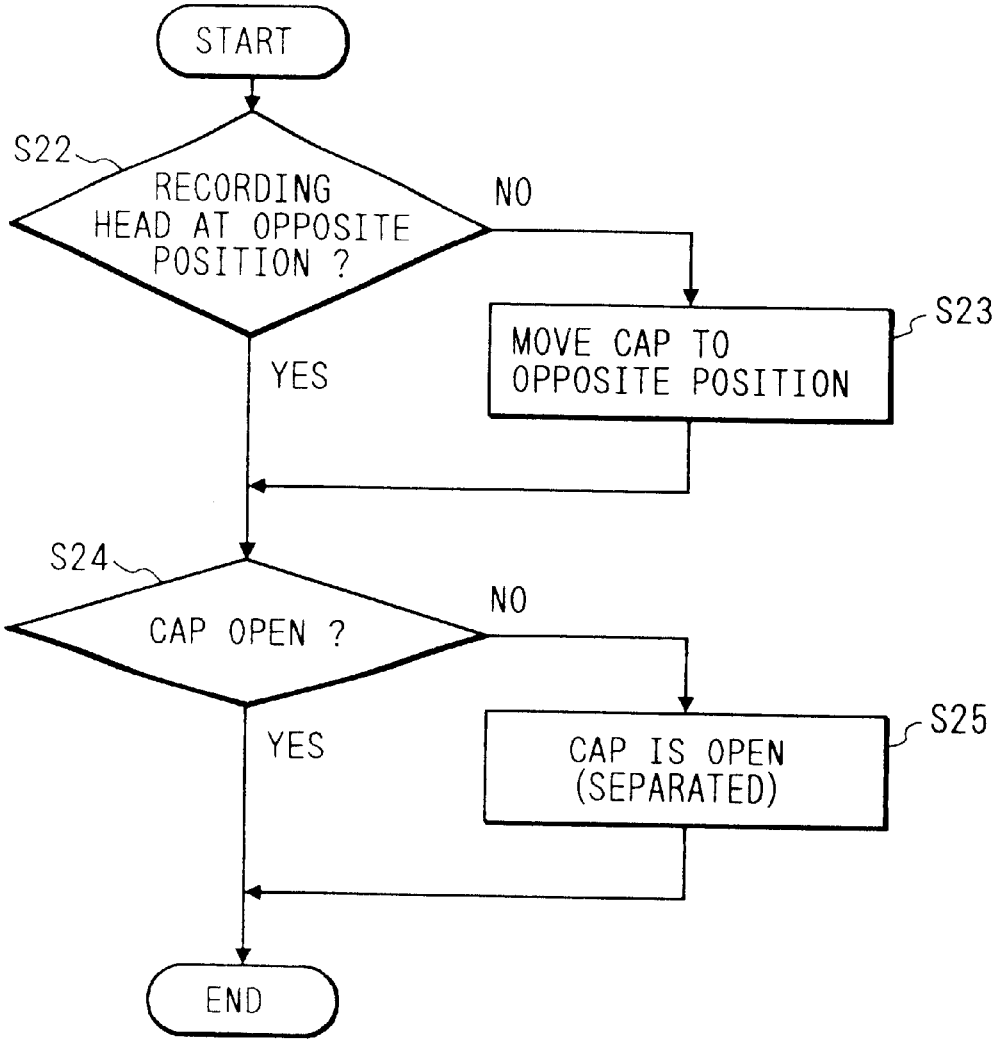
FIG. 14 is a flow chart showing a method for moving the recording head to a position opposed to a cap, described in the first embodiment.

Since the detection of the ink discharge state involves ink discharging operation, it is executed, as in the preliminary discharge explained before, at the home position where the carriage is opposed to the cap 222. FIG. 14 is a flow chart showing said detection process. When the detection sequence is initiated, there is discriminated, by unrepresented position detecting means, whether the head cartridge 201 is located at the position opposed to the cap (step S22), and, if not, the carriage is moved to the position opposed to the cap 222 (steps S23, S24). If the step S22 identifies that the head cartridge 201 is positioned opposite to the cap, a step S24 discriminates whether the cap 222 is in contact with the face including the ink discharge openings, and, if in contact, the cap is opened (step S25). Said detection is executed while the cap 222 is not contacting said face including the ink discharge openings, in order to prevent that the ink discharged and received in the cap 222 comes into contact with said face.

In the detection of the ink discharge state, the ink discharge inducing energy, composed of 1000 pulses of a pulse duration of 7 μsec and a frequency of 4 kHz applied to all of 64 nozzles, causes the discharge of ink of about 5 mg. In order to avoid contamination of the interior of the recording apparatus by the discharged ink, it is discharged toward the cap. Also in the present embodiment, in order to ensure the reception of ink into the cap, and also for discarding the ink in the cap or in the pump 223 connected to the cap 222 in advance, the pump 223 is activated to effect suction while the cap 222 is separated from the face containing the discharge openings of the recording head. This operation is executed before and after said detection of the ink discharge state, whereby said detection can be conducted without contamination of the apparatus with ink.

If an abnormal discharge state is detected in said detection of the ink discharge state, an abnormality signal is generated to display a warning message, to turn on a light-emitting diode, or to inform an alarm by information means 1004 such as an alarm buzzer. When the abnormal state is eliminated by the user, there is executed a predetermined re-starting procedure.

As explained in the foregoing, the detection of the ink discharge state based on the temperature characteristics of the recording head allows exact detection without particular components therefor. Also the present embodiment enables detection with an inexpensive configuration, since the energy application for said detection of the ink discharge state is made to the ink discharge means, and since the temperature detection is achieved by a temperature sensor which is manufacturable simultaneously with the ink discharge means.

Also the above-explained second and third methods for detecting the ink discharge state are applicable even when the temperature characteristics of the recording head involve fluctuation. Consequently there can be provided advantages of alleviating the control of precision in the dimension and material of the heater board or base plate and in the thickness of the aforementioned adhesive material, thus reducing the manufacturing cost, and advantages that such methods are applicable regardless of the kind, physical properties and droplet size of the ink.

Also as the detection of the ink discharge state is executed when the recording head is opposed to an ink receiving member such as a cap, and as the ink is eliminated from said ink receiving member for example by the ink suction before and after said detection, the discharged ink can be securely captured and the contamination within the recording apparatus can be minimized.

The above-explained embodiment employs a diode sensor for detecting the temperature, but other sensors are likewise usable as long as the temperature of the recording head can be detected. For example the temperature can be detected by measuring the resistance of the electrothermal converters such as discharge heaters or other heaters. Also the temperature sensor is provided on the heater board, but such configuration is not limitative.

Furthermore, the recording apparatus may be provided with an ink receiving member composed for example of sponge, capable of absorbing and retaining the ink, separately from the cap 222, and the ink discharge for detecting the ink discharge state may be conducted on such ink receiving member. Also information by the informing means is given when an abnormal result is obtained by the detection, but the information may be provided in case said detection indicates a normal state, and the result of said detection may be provided by the recording apparatus or by the host apparatus.

[Embodiment 2]

According to the invention described in the first embodiment, an electrical energy is applied to the ink discharge heater to effect the heating thereof, in order to know the temperature characteristics of the recording head. However the heating means, to be used for heating the recording head for obtaining said temperature characteristics, is not limited to the discharge heaters, and there will be explained another method in the present embodiment. The recording head (head cartridge) of the first embodiment is provided, as already explained in relation to FIGS. 3A to 3C, with heaters 112*a*, 112*b* for temperature regulation of the recording head, in addition to the discharge heaters. Consequently the temperature characteristics of the recording head can be detected, also by applying a predetermined electrical energy to such heaters.

However, the ink discharge state cannot be detected from the temperature characteristics obtained by the heating of said heaters, since ink discharge is not induced by said heating.

For this reason, the following method is adopted for detecting the ink discharge state, in case the above-mentioned heaters not constituting the ink discharge means are used as the heating means for obtaining the temperature characteristics of the recording head.

As explained in the first embodiment, the difference in the temperature characteristics arises from whether the ink discharge is executed or not. It is therefore conceived to drive the discharge heaters also, for discharging the ink, in the course of activation of the above-mentioned heaters. Thus there can be obtained a temperature change of the heater board, similar to that shown in FIG. 6, according to the ink filling state in the nozzles and in the common liquid chamber connecting thereto. Consequently the method of the first embodiment can be likewise applied, by integrally considering the heating with the temperature-regulating heaters and that with the discharge heaters. The temperature characteristics not related to the ink filling state of the nozzles can be obtained by activating the temperature-regulating heaters only.

Figure 15A:
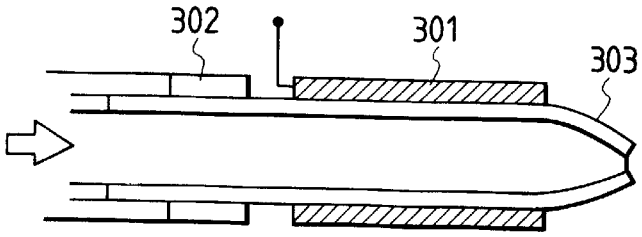
FIGS. 15A and 15B are views showing the structure and the principle of ink discharge of a recording head employing a piezoelectric device.
Figure 15B:
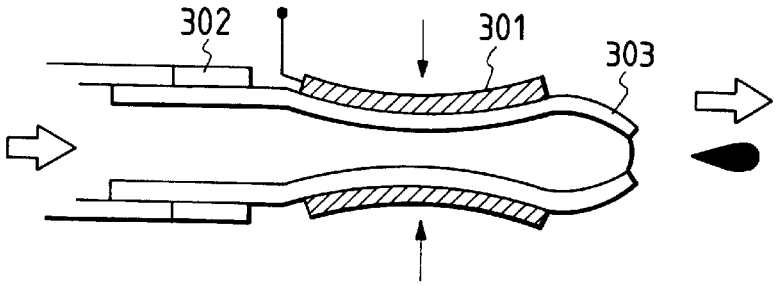

In the present embodiment, the detection of the temperature characteristics is achieved by heaters different from the discharge heaters. Consequently the discharge heaters are used only for the ink discharge, and the ink discharge means is not limited to heaters. Thus the present embodiment is applicable to the ink jet recording apparatus equipped with a heater different from the heaters for ink discharge. Ink discharge means not relying on the heater include those employing an electromechanical converter such as a piezoelectric element, and FIGS. 15A and 15B illustrate the cross-sectional view of such nozzle, wherein illustrated a piezoelectric element 301, a heater 302, and a discharge opening 303. FIG. 15B illustrates the principle of ink discharge. Ink is supplied from the left. A pulse supply to the piezoelectric element 301 generates a mechanical distortion therein, thus inducing ink discharge from the discharge opening 303.

[Embodiment 3]

Figure 16:
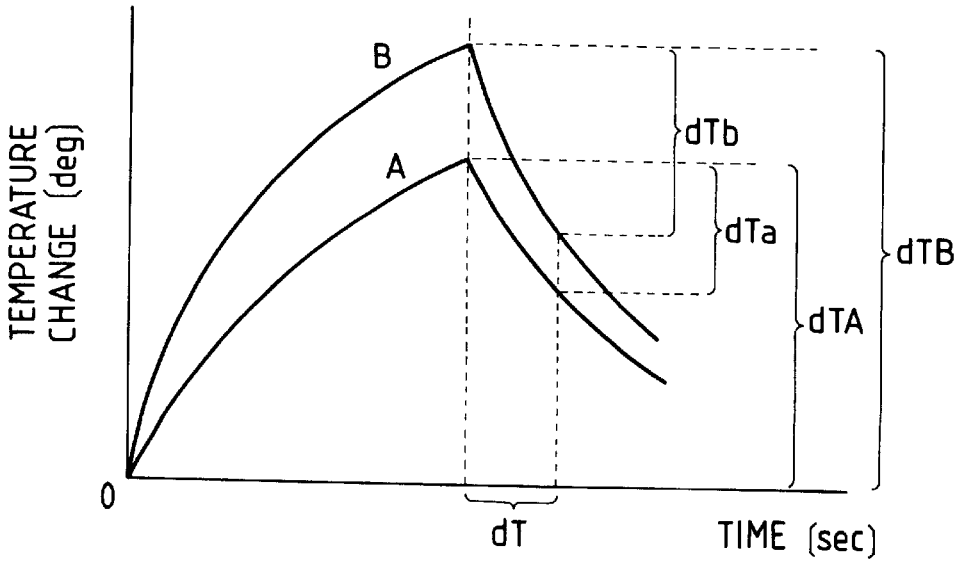
FIG. 16 is a chart showing the temperature change in the vicinity of the heater board during and after the application of an electrical energy to the discharge heater.

In the embodiments 1 and 2, the temperature characteristics are determined by detecting the rise in temperature of the recording head when an electrical energy is applied to the ink discharging heaters or the temperature-regulating heaters. However, the method of temperature measurement is not limited to such methods, and another method will be explained in the present embodiment. The heater board exhibits the temperature change as already explained in FIG. 6, when the electrical energy is applied to the heaters. After said energy application, the temperature of the heater board descends by heat dissipation, as shown in FIG. 16. Said temperature descent is determined by the temperature of the heater board at the end of application of the electrical energy, and the difference from the ambient temperature. Consequently the temperature changes dTa, dTb within a predetermined period dt after the end of application of the electrical energy are correlated with the temperature changes (increases) dTA, dTB caused by said energy application. Therefore, the method of the first embodiment can be still applied by measuring dTa, dTb and replacing the aforementioned values of dTA, dTB with thus measured values. In the method of this embodiment, the detection of temperature characteristics of the recording head is not affected by the noises resulting from the activation of the heaters, because said detection is executed after the end of application of the electrical energy to said heaters. Thus there is obtained an advantage that the timing of temperature detection with the temperature sensor can be arbitrarily selected.

[Embodiment 4]

Figure 17:
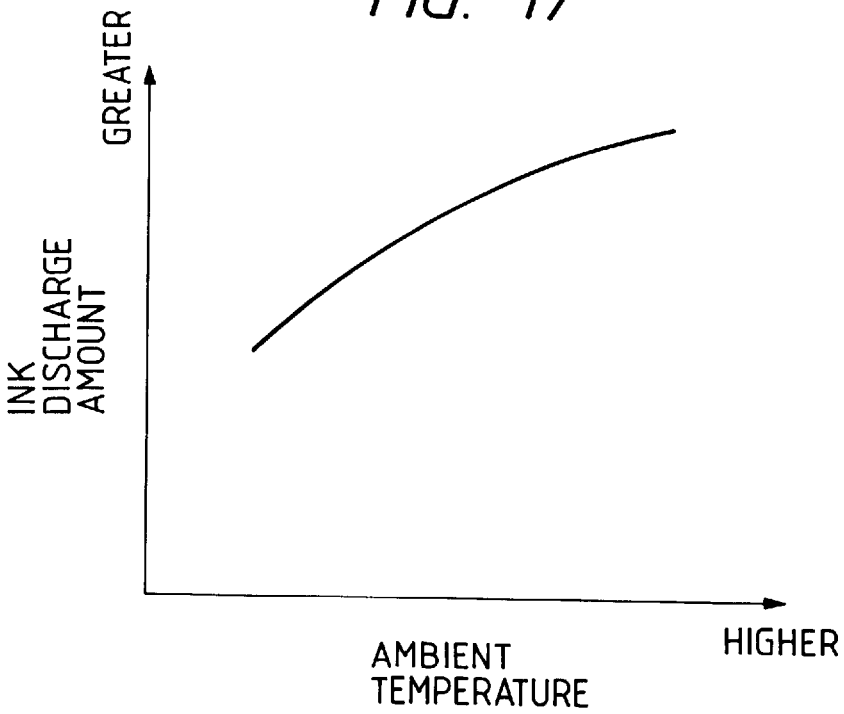
FIG. 17 is a chart showing the relationship between the ambient temperature and the discharged ink amount.

The ink jet recording method is influenced by a change in the physical properties of the ink, since the principle of ink discharge utilizes such physical properties. As a representative example, the amount of ink discharge varies depending on the ambient temperature. In general, the amount of ink discharge in the ink jet recording decreases, as shown in FIG. 17, when the ambient temperature becomes lower, because the ink viscosity increases at a lower temperature.

If the ink discharge amount varies excessively by the ambient temperature, a correction for the ambient temperature may become necessary in the foregoing embodiments, and the present embodiment effects such correction for the temperature.

As already explained in the first embodiment, the difference in the temperature characteristics arises from the heat dissipation by the ink discharge. Thus the above-mentioned temperature change dTA becomes larger or smaller respectively when the ink discharge amount decreases or increases from the normal amount. Stated differently, the variation in dTA by the ambient temperature becomes no longer negligible, if the ink discharge amount varies significantly depending on the ambient temperature.

Thus, there will be explained a method of preventing the excessive variation of dTA from the reference value at a reference temperature, despite of the variation of the ambient temperature. Such temperature compensation can be achieved by increasing or decreasing the energy applied to the heaters, respectively when the ambient temperature is lower or higher than the reference temperature. More specifically, there is determined an applied energy for providing the optimum dTA for each ambient temperature, by collecting data of dTA for different applied energies for each ambient temperature, and the energy applied to the heaters is controlled according to said data.

The applied energy may be varied by a change in the pulse duration, the number of applied pulses or the applied voltage.

It is also possible, instead of varying the energy applied to the heaters, to vary the criteria of judgment utilizing the detected temperature characteristics (temperature change) according to the ambient temperature.

For example, in the 3rd method of the first embodiment, the value of the constant K1 varies depending on the ambient temperature. It is therefore conceivable to calculate the constant K1 for each ambient temperature and to determine the optimum constant K for each ambient temperature.

[Embodiment 5]

In the following there will be explained an application in which the recording head is provided with plural temperature sensors.

Figure 18:
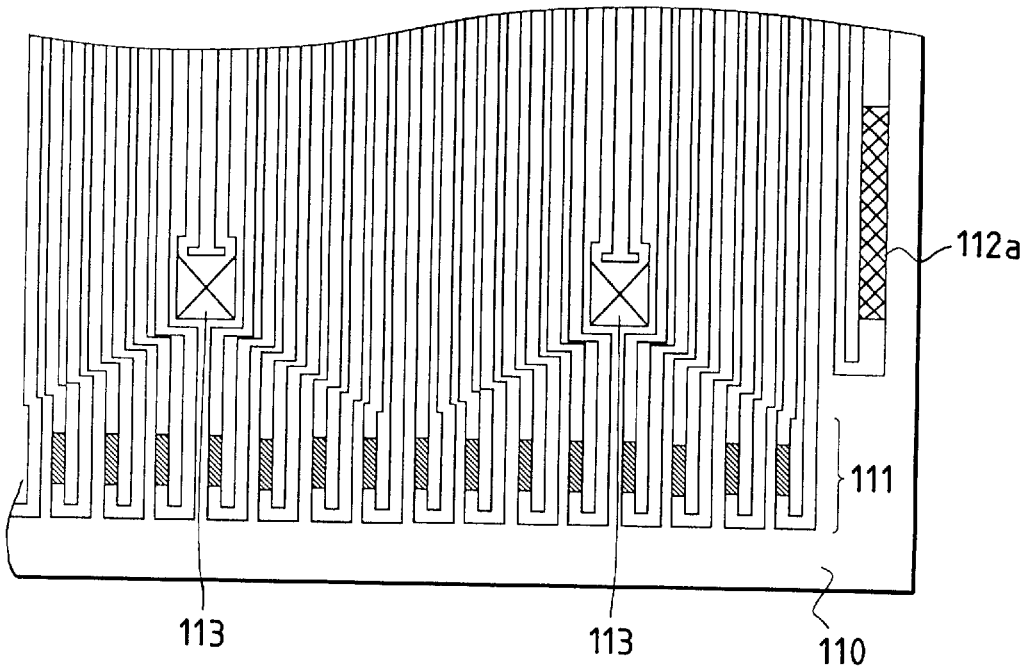
FIG. 18 is a schematic view of a recording head provided with a plurality of temperature sensors.

FIG. 18 shows a configuration of the heater board 110, in which, in the array of the discharge heaters 111, a temperature sensor 113 is provided for example for every eight discharge heaters. Thus, if the heater board 110 has 64 discharge heaters, there will be 8 temperature sensors 113 on the same heater board. The outputs dT1–dT8 of said eight temperature sensors are transmitted to the printer control unit shown in FIG. 5 and supplied to the MPU 1000. Based on each result of temperature detection, there can be discriminated whether the ink discharge state is normal or abnormal, according to the detecting procedure explained in the first embodiment.

Each temperature sensor represents best the temperature state in the vicinity of said sensor, so that an abnormal ink discharge state, identified by the temperature detection by a sensor, can be considered to indicate abnormal ink discharge of the ink discharge means in the vicinity of said sensor. In the present embodiment with plural temperature sensors, the abnormal state is informed by the informing means 1004 if an abnormal state is found in any of the detected temperature changes dT1–dT8, as shown in a flow chart in FIG. 19.

Figure 19:
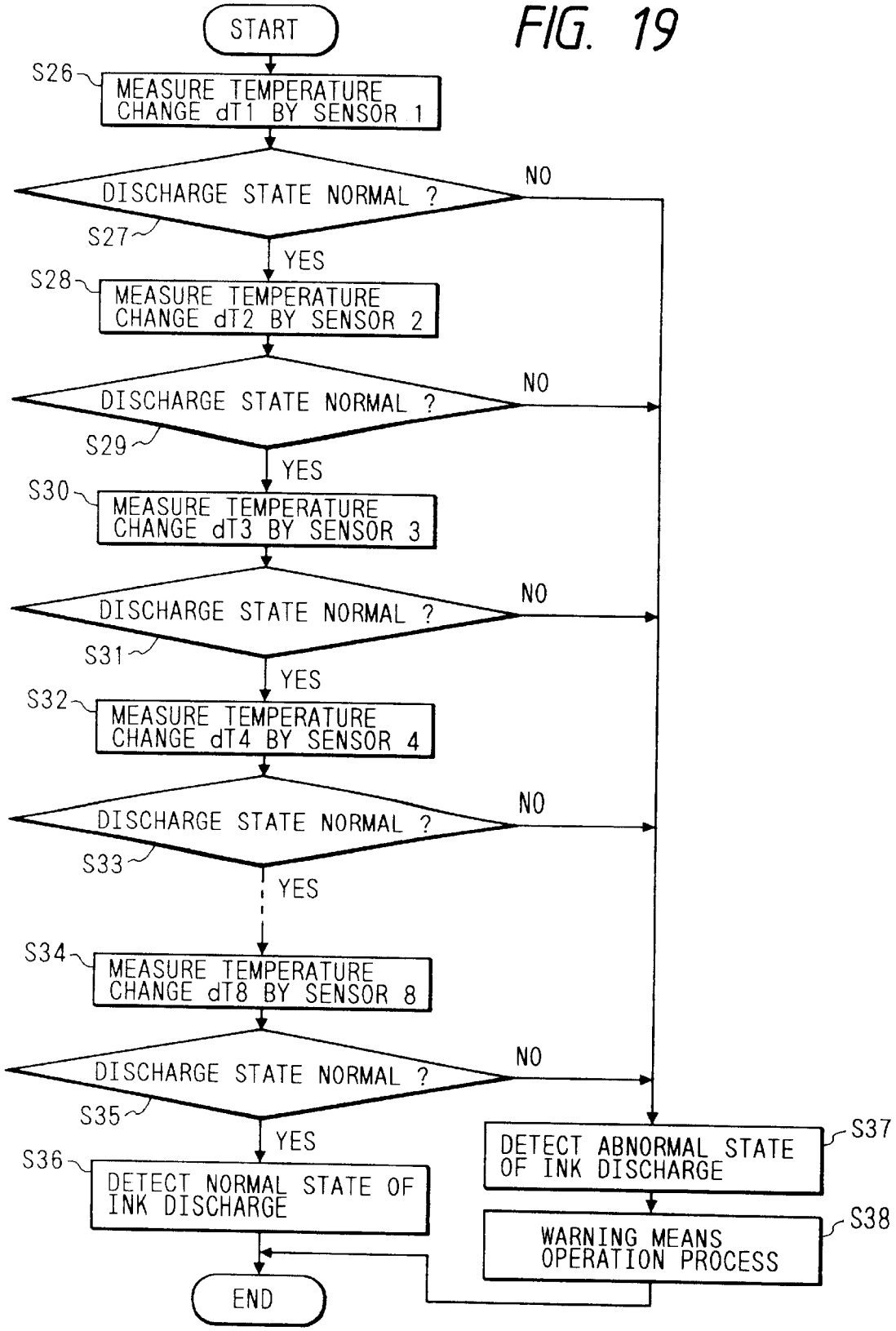
FIG. 19 is a flow chart showing an example of detection of the ink discharge state in a recording head provided with plural temperature sensors.

The control sequence of the present embodiment will be explained with reference to FIG. 19. At first a step S26 measures the temperature change dT1 by first temperature sensor 1. Based on said measurement, a step S27 effects the temperature comparison as explained in the first embodiment, and, if a step S37 identifies an abnormal discharge state, a step S38 generates an alarm. On the other hand, if the discharge state is normal according to the detection by the sensor 1, a step S28 measures the temperature change dT2 in a similar manner by a sensor 2. Thereafter the temperature detections are conducted to a sensor 8 in succession in a similar manner (steps S28 to S34), and the abnormality is informed by said informing means if the abnormal discharge state is detected in any of said sensors. On the other hand, if all the results of said sensors are normal, the ink discharge state is identified as normal.

A more accurate detection of the ink discharge state is made possible by the use of such plural temperature sensors. In the present embodiment, there is provided a temperature sensor for every eight discharge heaters, but such configuration is not limitative, and it is also possible to provide each discharge heater with an individual temperature sensor and to detect the ink discharge state for each discharge heater by detecting the temperature characteristics thereof. Also the abnormality is informed in case any of the detected results is abnormal, but such process can be arbitrarily selected according to the characteristics of the recording head or the structure of the recording apparatus. Also this embodiment is applicable to the ink jet recording head employing the aforementioned electromechanical converters, if it is provided with an electrothermal converter for temperature regulation, separate from the ink discharge means.

[Embodiment 6]

The detection of the ink discharge state according to the present invention is conducted, as explained in the first embodiment, after the completion of recording operation of every page, but timing of such detection may be rendered variable, as will be explained in the following.

Figure 20:
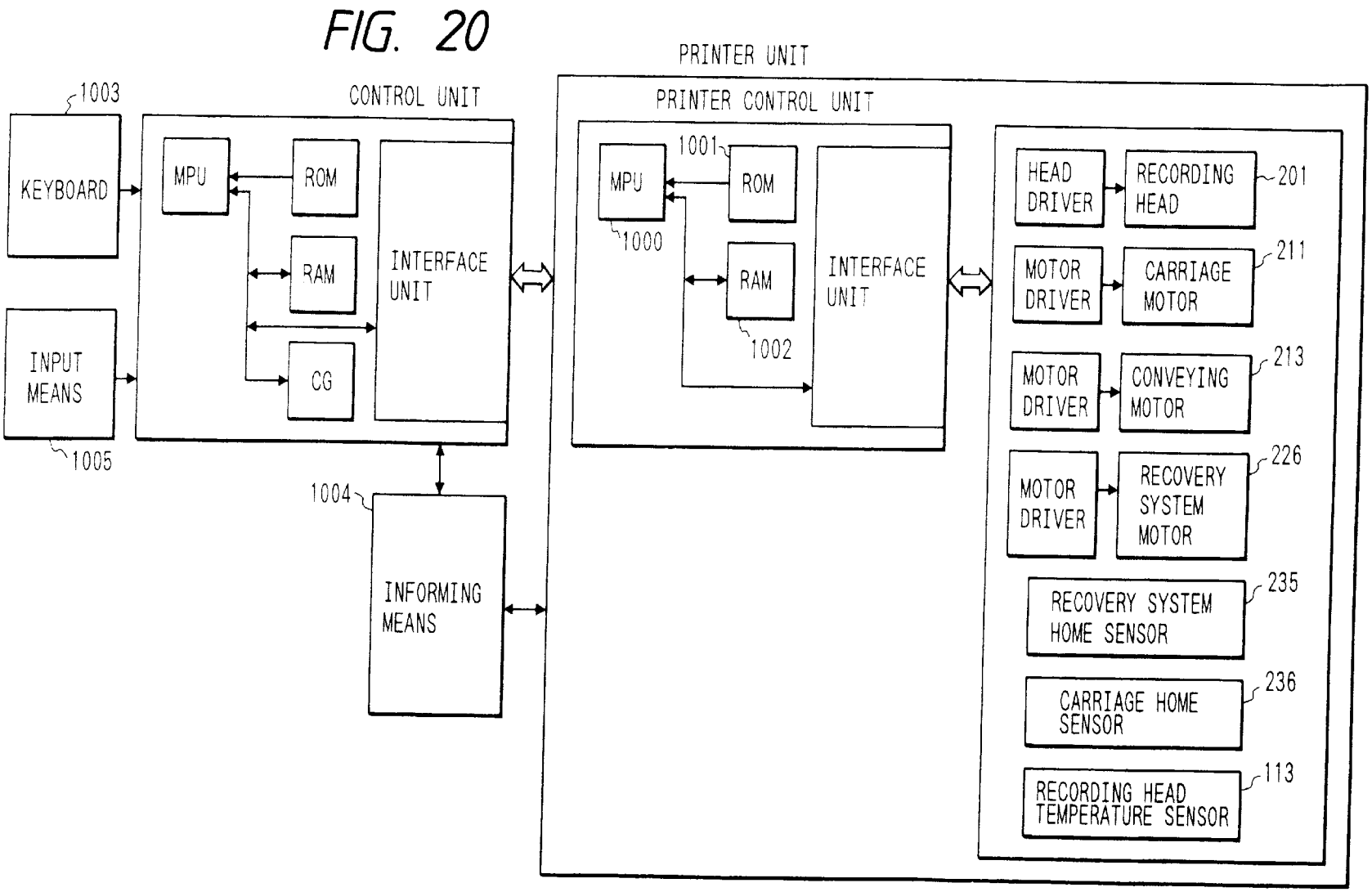
FIG. 20 is a block diagram of the control system of a recording apparatus constituting a sixth embodiment.

FIG. 20 is a block diagram of a recording apparatus in which the timing of said detection can be set in variable manner. Input means 1005 is provided, for entering said timing, separately from the keyboard, but said keyboard may also be used for said input means.

Since the detection of the ink discharge state involves the ink discharge, the amount of ink available for recording decreases, though slightly, when such detection is executed. The configuration in which the user can vary the timing of such detection allows to economize the ink amount consumed in such detection, and also allows to improve the accuracy of detection by effecting the detections at a short interval.

Figure 21:
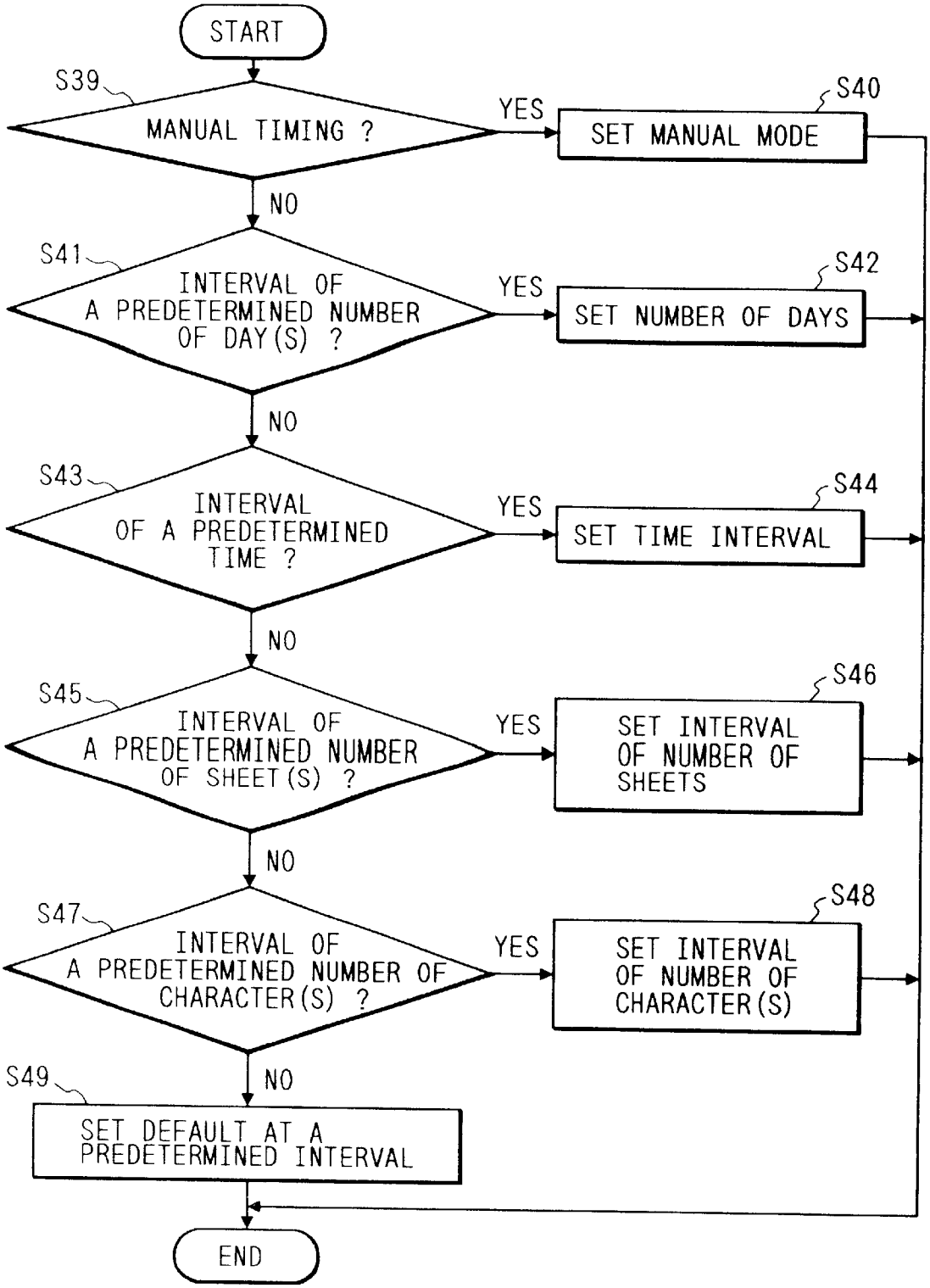
FIG. 21 is a flow chart showing the setting of variable timing of detection of the ink discharge state.

FIG. 21 is a flow chart for the setting of the timing of said detection. As an example, the detection is executed at an interval, in the automatic mode, selected either by a number of days (steps S41, S42), or by a number of hours (steps S43, S44), or by a number of recorded sheets (steps S45, S46) or by a number of recorded characters (steps S47, S48), or executed, in the manual mode, in response to an instruction entered from the input means 1005 (steps S39, S40). In addition to such presettable intervals, there may be selected a standard default interval, stored in the control unit of the recording apparatus (step S49).

The detection of the ink discharge state is executed according to the timing or the interval thus set.

Such settable timing of detection allows to economize the ink consumption required in the detection of the ink discharge state, and to improve the accuracy of detection. In the present embodiment, said manual mode is rendered selectable separately from the automatic mode in which the detection is executed at a preset interval, but it is also possible to combine both modes whereby the detection is normally executed at the present interval but is additionally executed in response to an instruction entered through the input means when necessary. Also the present embodiment is applicable to any ink jet recording apparatus, regardless of the means for detecting the ink discharge state or of the ink discharge means in the loaded recording head.

[Embodiment 7]

Figure 22:
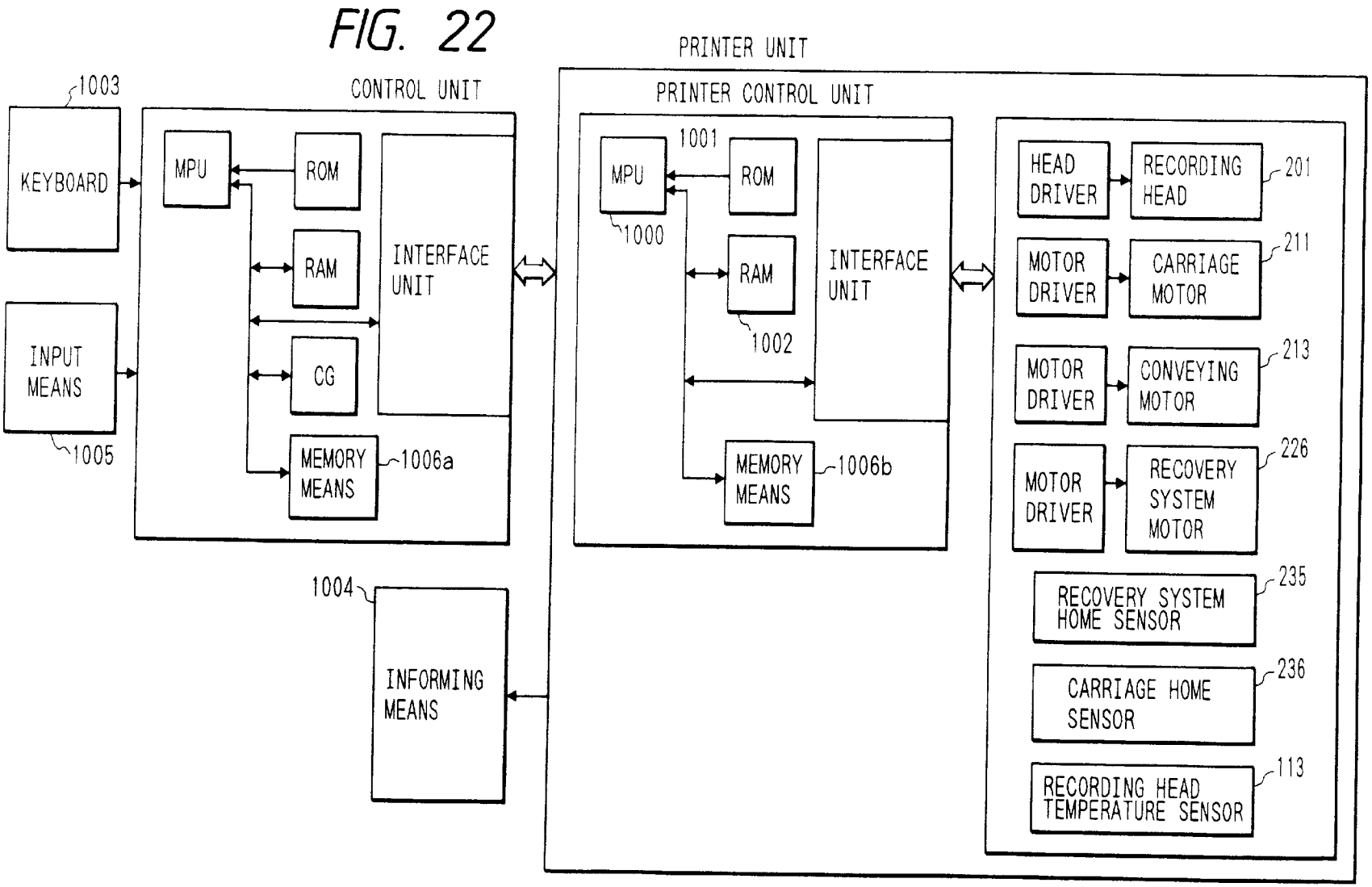
FIG. 22 is a block diagram of the control system of a recording apparatus constituting a seventh embodiment.

In the following there will be explained an ink jet recording apparatus capable of detecting the ink discharge state, provided with memory means capable of retaining a series of recording data, and adapted to retain the recording data in case abnormality is detected in said detection and to repeat the recording operation according to thus retained data. FIG. 22 is a block diagram of such recording apparatus, in which provided input means 1005, capable of entering the timing of detection of the ink discharge state and an instruction for detection in the manual mode as explained in the preceding embodiment, and memories 1006*a*, 1006*b* capable of retaining a series of recording data. Said memories may be provided only in either of the printer unit and the control unit.

Figure 23:
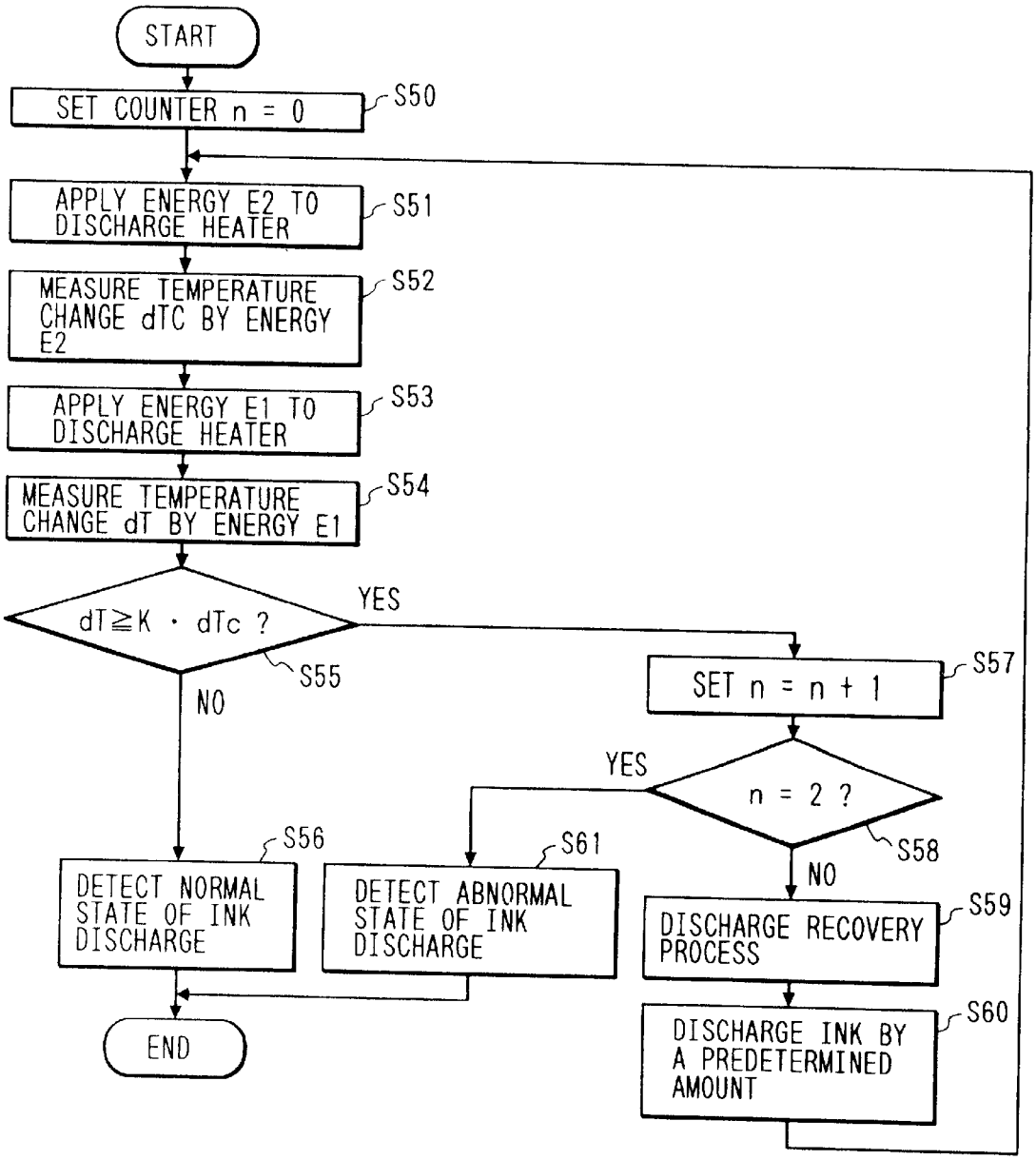
FIG. 23 is a flow chart showing the repeated detection of the ink discharge state and steps before said repeated detection.

At first, with respect to the detection of the ink discharge state of the present embodiment, there will be explained the difference from the method of the first embodiment, with reference to the flow chart shown in FIG. 23. Said detection is executed by the method already explained in the first embodiment, but an improved accuracy of detection is attained by executing, once abnormal discharge state is detected, another detection of the discharge state after an automatic discharge recovery operation including the ink suction from the recording head (step S59) and an ink discharge operation of a predetermined amount (step S60), and the abnormality is identified if the abnormality is detected in such repeated detection also after the initial abnormality detection.

Said discharge recovery operation and said ink discharge of predetermined amount are executed in order to confirm whether the initial abnormality detection is due to the exhaustion of ink in the recording head. More specifically, said operations are executed in order to discriminate whether the initial abnormality detection is due to bubble formation in the ink path of the recording head or interruption of ink supply for example by the meniscus destruction resulting from vibration at the ink discharge openings, that may occur prior to the exhaustion of ink, or due to ink exhaustion in the recording head.

If the ink is not yet exhausted, the ink supply from the ink tank can be restored by the discharge recovery operation including the suction operation (step S59), and, the ink supply is secured by the ink discharge of a predetermined amount in the step S60. Thus the normal ink discharge state is confirmed in the repeated detection. However, if said detected abnormality is due to the ink exhaustion, the secure ink supply cannot be restored in the discharge recovery operation. Even if the ink of a small amount is guided to the ink discharge means by said suction operation from the ink tank, the ink supply will be again interrupted in the succeeding ink discharge operation of the predetermined amount, so that the discharge abnormality is detected again in the repeated detection.

Figure 24:
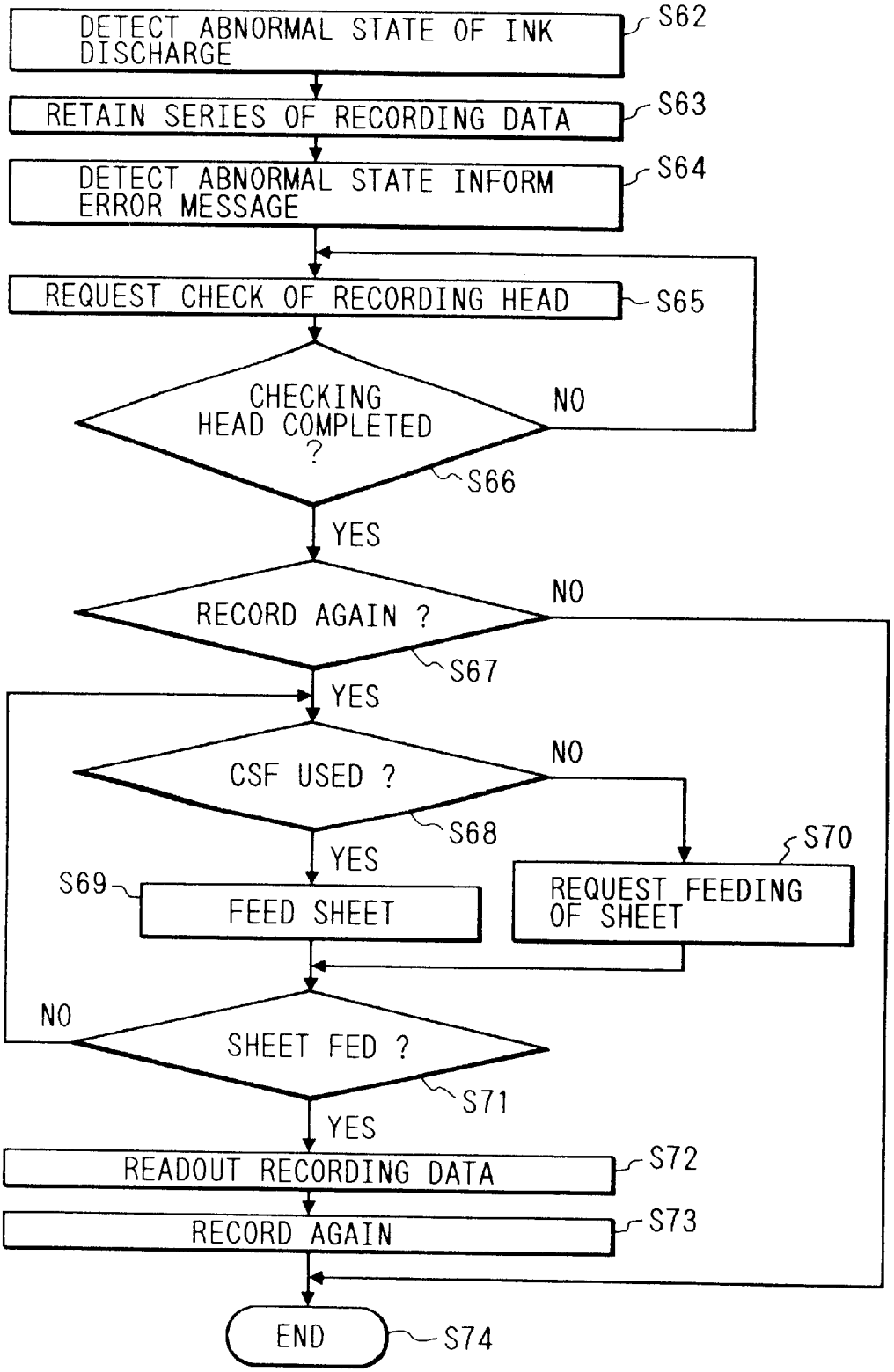
FIG. 24 is a flow chart showing the function of a recording apparatus capable of re-recording, constituting a seventh embodiment.

FIG. 24 is a flow chart showing the control sequence in which the recording data are retained in the memory means 1006 shown in FIG. 22, whereby the loss of the recording data, resulting from the abnormality in discharge, can be prevented. When an abnormality in ink discharge is detected (step S62), the serial recording data that have been recorded at said detection are stored in the memory means 1006 (step S63). Then the detection of abnormality is informed (step S64), and the inspection of the recording head is requested (step S65). Upon detection of the completion of such inspection or of the replacement of the recording head (step S66), and in response to the entry of a command for re-recording (step S67), there is discriminated whether a cassette sheet feeder (CSF) is mounted on the recording apparatus (step S68), and, if mounted, the sheet feeding operation is conducted (step S69), but, if not mounted, the sheet feeding is requested for example by a message display (step S70). After the sheet feeding operation is confirmed (branch YES in step S71), the recording data are read from said memory means 1006 (step S72) and the re-recording operation is conducted, based on said recording data (step S73).

In the present embodiment, the position of the recording data, from which the re-recording is to be started, can be instructed, so that the re-recording is executed from a data position which can be arbitrarily instructed according to the location of the abnormality in the recording. This embodiment is particularly suitable, among various recording apparatus, for use in the communication equipment such as the facsimile apparatus, in which the necessity for re-recording after the abnormality detection is high and the loss of recording data is considered critical.

As explained in the foregoing, it is rendered possible to improve the accuracy of detection, by repeating the detection for ink discharge state, after a discharge recovery operation including a sucking operation and after a predetermined ink discharging operation, and also to prevent the loss of recorded data resulting from discharge abnormality, by retaining the recording data.

In the present embodiment, the completion of inspection of the recording head or of replacement thereof may be entered by the user through the input means. However, such information may be also obtained automatically by detecting the replacement of the recording head or the detachment and attachment thereof.

The present invention has been explained by embodiments of the recording apparatus equipped with so-called serial-type recording head, but it is likewise applicable to the recording apparatus employing so-called full-line recording head.

The present invention is particularly suitably usable in an ink jet recording head and recording apparatus wherein thermal energy by an electrothermal transducer, laser beam or the like is used to cause a change of state of the ink to eject or discharge the ink. This is because the high density of the picture elements and the high resolution of the recording are possible.

The typical structure and the operational principle are preferably the ones disclosed in U.S. Pat. Nos. 4,723,129 and 4,740,796. The principle and structure are applicable to a so-called on-demand type recording system and a continuous type recording system. Particularly, however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provided by the electrothermal transducer to produce film boiling on the heating portion of the recording head, whereby a bubble can be formed in the liquid (ink) corresponding to each of the driving signals. By the production, development and contraction of the bubble, the liquid (ink) is ejected through an ejection outlet to produce at least one droplet. The driving signal is preferably in the form of a pulse, because the development and contraction of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion, as well as the structure of the combination of the ejection outlet, liquid passage and the electrothermal transducer as disclosed in the above-mentioned patents. In addition, the present invention is applicable to the structure disclosed in Japanese Laid-Open Patent Application No. 59-123670 wherein a common slit is used as the ejection outlet for plural electrothermal transducers, and to the structure disclosed in Japanese Laid-Open Patent Application No. 59-138461 wherein an opening for absorbing pressure wave of the thermal energy is formed corresponding to the ejecting portion. This is because the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head and plural recording head combined to cover the maximum width.

In addition, the present invention is applicable to a serial type recording head wherein the recording head is fixed on the main assembly, to a replaceable chip type recording head which is connected electrically with the main apparatus and can be supplied with the ink when it is mounted in the main assembly, or to a cartridge type recording head having an integral ink container.

The provisions of the recovery means and/or the auxiliary means for the preliminary operation are preferable, because they can further stabilize the effects of the present invention. As for such means, there are capping means for the recording head, cleaning means therefor, pressing or sucking means, preliminary heating means which may be the electrothermal transducer, an additional heating element or a combination thereof. Also, means for effecting preliminary ejection (not for the recording operation) can stabilize the recording operation.

As regards the variation of the recording head mountable, it may be a single corresponding to a single color ink, or may be plural corresponding to the plurality of ink materials having different recording color or density. The present invention is effectively applicable to an apparatus having at least on of a monochromatic mode mainly with black, a multi-color mode with different color ink materials and/or a full-color mode using the mixture of the colors, which may be an integrally formed recording unit or a combination of plural recording heads.

Furthermore, in the foregoing embodiment, the ink has been liquid. It may be, however, an ink material which is solidified below the room temperature but liquefied at the room temperature. Since the ink is controlled within the temperature not lower than 30° C. and not higher than 70° C. to stabilize the viscosity of the ink to provide the stabilized ejection in usual recording apparatus of this type, the ink may be such that it is liquid within the temperature range when the recording signal is the present invention is applicable to other types of ink. In one of them, the temperature rise due to the thermal energy is positively prevented by consuming it for the state change of the ink from the solid state to the liquid state. Another ink material is solidified when it is left, to prevent the evaporation of the ink. In either of the cases, the application of the recording signal producing thermal energy, the ink is liquefied, and the liquefied ink may be ejected. Another ink material may start to be solidified at the time when it reaches the recording material. The present invention is also applicable to such an ink material as is liquefied by the application of the thermal energy. Such an ink material may be retained as a liquid or solid material in through holes or recesses formed in a porous sheet as disclosed in Japanese Laid-Open Patent Application No. 54-56847 and Japanese Laid-Open Patent Application No. 60-71260. The sheet is faced to the electrothermal transducers. The most effective one for the ink materials described above is the film boiling system.

The ink jet recording apparatus may be used as an output terminal of an information processing apparatus such as computer or the like, as a copying apparatus combined with an image reader or the like, or as a facsimile machine having information sending and receiving functions.

While the invention has been described with reference to the structures disclosed herein, it is not confined to the details set forth and this application is intended to cover such modifications or changes as may come within the purposes of the improvements or the scope of the following claims.

As stated above, according to the invention, since temperature characteristics is detected for each recording head, the temperature characteristics is applied to various uses so that it is possible to obtain results not depend on difference of each recording head. In addition by utilizing the detection results of the temperature characteristics an accurate detection of ink discharge state is possible. Furthermore, according to the present invention it is possible to detect the abnormal state of the ink discharge which might occur before ink is consumed up.

What is claimed is:

1. An ink jet recording apparatus for recording on a recording medium using a recording head mounted thereto for discharging an ink from a plurality of discharge openings onto the recording medium, comprising:

an electrothermal converter provided on said recording head;

temperature detection means, thermally coupled to said recording head, for detecting a temperature of said recording head; and temperature characteristic detection means for applying a predetermined amount of energy to said electrothermal converter, and detecting a temperature change of said recording head resulting from an application of the predetermined energy, thereby determining a temperature characteristic of said recording head mounted to the apparatus, based on a result of such detecting, said temperature characteristic being a specific characteristic of said recording head.

2. An ink jet recording apparatus according to claim 1, further comprising:

judgment means for judging an ink discharge state of said recording head, based on the result of such detecting of the temperature characteristic of the recording head by said temperature characteristic detection means, and providing a judgment result.

3. An ink jet recording apparatus according to claim 2, further comprising:

informing means for providing information, based on the judgment result of the ink discharge state by said judgment means.

4. An ink jet recording apparatus according to claim 2, wherein the temperature detection means for said recording head is provided in a plurality of units, and determining of the temperature characteristic of the recording head and judgment of the ink discharge state are conducted according to a result of temperature detection in a predetermined number of the temperature detection means among said plural units.

5. An ink jet recording apparatus according to claim 2, further comprising:

input means which enables a user to enter an instruction for execution of detection of said ink discharge state, wherein said judgment means judges the ink discharge state in response to the instruction entered by the user through said input means.

6. An ink jet recording apparatus according to claim 1, wherein said electrothermal converter is a heater.

7. An ink jet recording apparatus according to claim 6, wherein the predetermined amount of energy applied to said electrothermal converter is sufficient to induce ink discharge.

8. An ink jet recording apparatus according to claim 6, wherein the predetermined amount of energy applied to said electrothermal converter is insufficient to induce ink discharge.

9. An ink jet recording apparatus according to claim 6, wherein the predetermined amount of energy applied to said electrothermal converter includes an amount inducing ink discharge and another amount not inducing ink discharge.

10. An ink jet recording apparatus according to claim 1, wherein said electrothermal converter is a heater having a purpose other than for ink discharge.

11. An ink jet recording apparatus according to claim 1, wherein said temperature characteristic detection means detects the temperature characteristic of said recording head based on a temperature increase of said recording head detected by said temperature detection means, when said predetermined energy is applied to said electrothermal converter.

12. An ink jet recording apparatus according to claim 1, wherein said temperature characteristic detection means detects the temperature characteristic of said recording head, based on a temperature decrease of said recording head detected by said temperature detection means, after the applying of the predetermined amount of energy to said electrothermal converter.

13. An ink jet recording apparatus according to claim 1, wherein the applying of said predetermined amount of energy to said electrothermal converter is conducted by supplying plural pulses in cycles at a predetermined interval.

14. An ink jet recording apparatus according to claim 13, wherein detecting the temperature change in said recording head by said temperature detection means is conducted in synchronization with the cycles of said pulses.

15. An ink jet recording apparatus according to claim 1, further comprising:

ambient temperature detection means for detecting an ambient temperature of said recording head, wherein said temperature characteristic detection means corrects the result of detection of the temperature change in said recording head, according to the ambient temperature detected by said ambient temperature detection means.

16. An ink jet recording apparatus according to claim 1, further comprising:

ambient temperature detection means for detecting an ambient temperature of said recording head, wherein said temperature characteristic detection means varies the amount of energy applied to said electrothermal converter for the purpose of determining the temperature characteristic of said recording head, based on the ambient temperature detected by said ambient temperature detection means.

17. An ink jet recording apparatus according to claim 1, further comprising:

an ink receiving member for receiving the ink discharged from the discharge opening of said recording head; and means for controlling the relative position of said recording head and said ink receiving member in such a manner that said recording head opposes said ink receiving member when an energy sufficient to induce ink discharge is applied to said electrothermal converter, to detect the temperature characteristic of said recording head.

18. An ink jet recording apparatus according to claim 1, further comprising:

an ink receiving member for receiving the ink discharged from the discharge opening of said recording head;

means for removing the ink from said ink receiving member; and means for activating said ink removing means, at the application of energy in an amount sufficient to induce ink discharge to said electrothermal converter to detect the temperature characteristic of said recording head, at least before the energy application.

19. An ink jet recording apparatus according to claim 1, wherein the temperature characteristic of said recording head includes the temperature change therein when energy in an amount insufficient to induce the ink discharge is applied to said electrothermal converter.

20. An ink jet recording apparatus according to claim 1, wherein the temperature characteristic of said recording head includes the temperature change therein when energy in an amount sufficient to induce the ink discharge is applied to said electrothermal converter, in a state in which said recording head is filled with the ink.

21. An ink jet recording apparatus according to claim 1, wherein the temperature characteristic of said recording head includes a temperature change therein when the energy in an amount sufficient to induce ink discharge is applied to said electrothermal converter, in a state in which said recording head is not filled with the ink.

22. An ink jet recording apparatus according to claim 1, wherein said recording head induces a state change including bubble generation in the ink, using thermal energy, and effects ink discharge based on said state change.

23. An ink jet recording apparatus according to claim 1, wherein said temperature characteristic is specified with respect to said recording head.

24. A method of recording upon a recording medium, comprising the steps of:

providing an ink jet recording apparatus for recording on the recording medium using a mounted recording head for discharging ink from a plurality of discharge openings onto the recording medium, the recording apparatus including an electrothermal converter provided on the recording head;

detecting a temperature of the recording head; and applying a predetermined amount of energy to said electrothermal converter, and detecting a temperature change of said recording head resulting from an application of the predetermined energy, thereby determining a temperature characteristic of said recording head mounted to the apparatus, based on a result of said detecting, the temperature characteristic being a specific characteristic of the recording head.

25. An ink jet recording apparatus according to claim 1, wherein the temperature characteristic of said recording head is a characteristic resulting from a difference between at least one of a heat generation amount and a heat dissipation amount of said recording head and that of at least one other associated recording head.

26. A method according to claim 24, wherein the temperature characteristic of said recording head is a characteristic resulting from a difference between at least one of a heat generation amount and a heat dissipation amount of said recording head and that of at least one other associated recording head.

* * * * *